US009067417B2

(12) United States Patent
Komatsu et al.

(10) Patent No.: US 9,067,417 B2
(45) Date of Patent: Jun. 30, 2015

(54) INK JET RECORDING APPARATUS AND MAINTENANCE LIQUID FOR INK JET RECORDING APPARATUS

(75) Inventors: Hidehiko Komatsu, Chino (JP); Hiroshi Nagasaki, Shimasuma-machi (JP); Jun Shimazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/080,158

(22) Filed: Apr. 5, 2011

(65) Prior Publication Data

US 2011/0242206 A1 Oct. 6, 2011

(30) Foreign Application Priority Data

Apr. 5, 2010 (JP) ..... 2010-087023

(51) Int. Cl.
*B41J 2/165* (2006.01)

(52) U.S. Cl.
CPC ..... *B41J 2/16552* (2013.01); *B41J 2/16505* (2013.01)

(58) Field of Classification Search
USPC ..... 347/28, 29, 32, 95
See application file for complete search history.

(56) References Cited

U.S. PATENT DOCUMENTS

| | | | | |
|---|---|---|---|---|
| 5,609,671 | A | 3/1997 | Nagasawa | |
| 5,928,419 | A | 7/1999 | Uemura et al. | |
| 5,976,233 | A | 11/1999 | Osumi et al. | |
| 6,123,759 | A | 9/2000 | Mise et al. | |
| 6,136,286 | A | 10/2000 | Okuyama et al. | |
| 7,510,265 | B2 * | 3/2009 | Kang et al. | 347/33 |
| 7,686,417 | B2 * | 3/2010 | Ota | 347/28 |
| 8,123,334 | B2 * | 2/2012 | Yokouchi et al. | 347/47 |
| 2005/0018023 | A1 * | 1/2005 | Momose et al. | 347/95 |
| 2005/0128242 | A1 * | 6/2005 | Suzuki | 347/29 |
| 2006/0203032 | A1 * | 9/2006 | Takagi | 347/29 |
| 2007/0132807 | A1 * | 6/2007 | Ota | 347/22 |
| 2008/0152828 | A1 | 6/2008 | Mukai et al. | |
| 2008/0238984 | A1 * | 10/2008 | Yahiro | 347/28 |
| 2009/0033707 | A1 * | 2/2009 | Shimazaki | 347/29 |
| 2009/0109257 | A1 * | 4/2009 | Shimazaki | 347/31 |
| 2009/0315942 | A1 * | 12/2009 | Parazak et al. | 347/28 |
| 2010/0040782 | A1 * | 2/2010 | Arai et al. | 427/256 |
| 2011/0234692 | A1 * | 9/2011 | Haijima et al. | 347/28 |
| 2013/0293651 | A1 | 11/2013 | Mukai et al. | |

FOREIGN PATENT DOCUMENTS

| | | | |
|---|---|---|---|
| JP | 56-28256 | A | 3/1981 |
| JP | 356573 | A | 3/1991 |
| JP | 3-79678 | A | 4/1991 |

(Continued)

*Primary Examiner* — Matthew Luu
*Assistant Examiner* — Lily Kemathe
(74) *Attorney, Agent, or Firm* — Nutter McClennen & Fish LLP; John J. Penny, Jr.

(57) ABSTRACT

An ink jet recording apparatus includes an ejection head which ejects an aqueous ink composition containing a resin component, a water-soluble organic solvent having a boiling point of 250° C. or less, a surfactant, and water; a first cap device which covers and moisturizes the ejection head; and a first maintenance liquid supply device which supplies a maintenance liquid to the first cap device. The maintenance liquid contains water and at least one water-soluble organic solvent of alkanediols having a boiling point of 250° C. or less and alkylene glycol monoether derivatives having a boiling point of 250° C. or less.

14 Claims, 8 Drawing Sheets

(56) References Cited

FOREIGN PATENT DOCUMENTS

| | | | |
|---|---|---|---|
| JP | 03160068 | A | 7/1991 |
| JP | 4-18462 | A | 1/1992 |
| JP | H07-89092 | A | 4/1995 |
| JP | 7-258578 | A | 10/1995 |
| JP | 8-3498 | A | 1/1996 |
| JP | 8-283596 | A | 10/1996 |
| JP | 10-110110 | A | 4/1998 |
| JP | 10-110111 | A | 4/1998 |
| JP | 10-110114 | A | 4/1998 |
| JP | 10-120958 | A | 5/1998 |
| JP | 10-195331 | A | 7/1998 |
| JP | 10-195360 | A | 7/1998 |
| JP | 10-237349 | A | 9/1998 |
| JP | 10-330665 | A | 12/1998 |
| JP | 3911928 | A | 4/2001 |
| JP | 2001-138540 | A | 5/2001 |
| JP | 2002-205412 | A | 7/2002 |
| JP | 2003-334962 | A | 11/2003 |
| JP | 2008-173942 | A | 7/2008 |
| JP | 2008-214525 | A | 9/2008 |
| JP | 2009-114454 | | 5/2009 |
| JP | 2009-226719 | A | 10/2009 |
| JP | 2009-233911 | A | 10/2009 |
| JP | 2010-058268 | A | 3/2010 |

* cited by examiner

INK JET RECORDING APPARATUS AND MAINTENANCE LIQUID FOR INK JET RECORDING APPARATUS

BACKGROUND

1. Technical Field

The present invention relates to an ink jet recording apparatus and a maintenance liquid for an ink jet recording apparatus.

2. Related Art

Since an ink jet recording apparatus ejects inks on recording media through fine nozzles provided in a head, the inks may be unsatisfactorily ejected by clogging of the fine nozzles due to thickening of the inks. In particular, when an aqueous ink composition is used as an ink, water as a main solvent of the ink is easily evaporated, and thus attempts have been made for preventing clogging due to drying and thickening of the inks by previously adding a high-boiling-point organic solvent such as glycerin to the aqueous ink composition. However, when an ink jet recording apparatus is not used over a long period of several days or more, there may occur defective ejection due to nozzle clogging of a head and a trouble due to drying and solidification of the ink in a moisture retention cap device of the head.

When an ink jet recording apparatus is not used for a long period of time, in order to suppress such defective ink ejection, it is proposed that drying of a head is prevented by replacing the ink in the head with a moisturizer (for example, Japanese Patent No. 3911928).

There is also proposed an ink jet recording apparatus in which under a non-printing state, drying of residual ink is suppressed by covering a head with a moisture retention cap device and supplying a moisturizer to a space in the moisture retention cap device in order to moisturize the head (for example, Japanese Unexamined Patent Application Publication No. 2003-334962).

As the moisturizer used in Japanese Patent No. 3911928 and Japanese Unexamined Patent Application Publication No. 2003-334962, a moisturizer containing only water and a moisturizer containing water and a high-boiling-point organic solvent such as glycerin are proposed.

However, the above-described moisturizer may be decayed by long-term use. In addition, when a moisture retention cap device containing the moisturizer to which a high-boiling-point organic solvent is added is allowed to stand for a long period of time, water is evaporated from the moisturizer in the moisture retention cap device, thereby concentrating the high-boiling-point organic solvent in the moisture retention cap. Therefore, water in an aqueous ink composition adhering to the head may be absorbed by the concentrated high-boiling-point organic solvent, thereby causing clogging of the head.

Alternatively, in an ink jet recording apparatus used for printing on non-ink-absorbing recording media such as plastic films, in order to improve the drying property of images formed on the recording media and to improve the fixability and abrasion resistance of images, it is necessary to decrease the amount of a high-boiling-point organic solvent, such as glycerin, contained in an ink composition. Therefore, in an ink jet recording apparatus using an ink composition improved in drying property, the aqueous ink composition having the high drying property is dried and solidified within a short time of several hour units in a flushing cap device of ejecting an ink for preventing nozzle clogging of a head or in a cap device for suction recovery for removing an ink in nozzles by suction, thereby causing an operation error.

That is, in comparison with the trouble of nozzle clogging in a head when an ink jet recording apparatus is allowed to stand without being used for a long period of time, a trouble due to drying and solidification of a residual ink in the maintenance cap device may occur more often within a short time when the residual ink is opened to air during an operation of the ink jet recording apparatus.

An ink jet recording apparatus provided with a plurality of ink jet heads has a problem that a cap is provided for each of the heads according to the applications of the caps.

In an ink jet recording apparatus provided with a plurality of ink jet heads, ejection conditions vary from head to head, and thus drying conditions of cap devices corresponding to the respective heads vary. For example, it is difficult to provide a detector on each of the cap devices and prevent drying by supplying a moisturizer.

SUMMARY

An advantage of some aspects of the invention is that the invention provides an ink jet recording apparatus excellent in antiseptic properties of a maintenance liquid and excellent in humidification in a cap device.

The present invention has been achieved for resolving part of the above-described problems and can be realized as an embodiment or application example below.

Application Example 1

An ink jet recording apparatus according to an embodiment of the present invention includes an ejection head which ejects an aqueous ink composition containing a resin component, a water-soluble organic solvent having a boiling point of 250° C. or less, a surfactant, and water; a first cap device which covers and moisturizes the ejection head; and a first maintenance liquid supply device which supplies a maintenance liquid to the first cap device, the maintenance liquid containing water and at least one water-soluble organic solvent of alkanediols having a boiling point of 250° C. or less and alkylene glycol monoether derivatives having a boiling point of 250° C. or less.

In the ink jet recording apparatus of Application Example 1, even when an aqueous ink composition which is easy to dry is used, the ejection head can be sufficiently moisturized because the maintenance liquid can be supplied to the first cap device. In addition, the number of maintenance works for the first cap device can be decreased because of the excellent antiseptic properties of the maintenance liquid.

Application Example 2

The ink jet recording apparatus of Application Example 1 may further include a second cap device which covers the ejection head and receives the aqueous ink composition discharged from the ejection head, a suction device which is connected to the second cap device to suck in the aqueous ink composition, a third cap device which covers and moisturizes the second cap device, and a second maintenance liquid supply device which supplies the maintenance liquid to the third cap device.

In the ink jet recording apparatus of Application Example 2, even when an aqueous ink composition which is easy to dry is used, the operation error of the second cap device can be decreased. Also, the number of maintenance works for the third cap device can be decreased because of the excellent antiseptic properties of the maintenance liquid.

Application Example 3

In Application Example 2, a plurality of ejection heads are provided, and the second cap device is provided to correspond to each of the ejection heads.

The ink jet recording apparatus of Application Example 3 has an excellent efficiency of ink suction because the liquid is sucked from the second cap device for each of the ejection heads.

Application Example 4

In Application Example 3, the plurality of ejection heads can be collectively covered with the first cap device.

The ink jet recording apparatus of Application Example 4 is capable of moisturizing collectively the plurality of ejection heads and thus capable of being simplified.

Application Example 5

The ink jet recording apparatus of any one of Application Examples 2 to 4 may further include a heating device which heats the maintenance liquid supplied to at least one of the first cap device and the third cap device.

In the ink jet recording apparatus of Application Example 5, the maintenance liquid can be effectively evaporated, and the insides of the first cap device and the third can be efficiently humidified.

Application Example 6

The ink jet recording apparatus of any one of Application Examples 2 to 5 may further includes an optical sensor which is provided on at least one of the first cap device and the third cap device in order to detect an amount of the maintenance liquid.

The ink jet recording apparatus of Application Example 6 is capable of accurately controlling the amount of the maintenance liquid.

Application Example 7

In the ink jet recording apparatus of any one of Application Examples 1 to 6, the maintenance liquid may further contain a pH adjuster.

The ink jet recording apparatus of Application Example 7 is capable of controlling the maintenance liquid to a pH value in a desired range.

Application Example 8

In the ink jet recording apparatus of Application Example 7, the maintenance liquid is adjusted to pH in a range of 5.0 or more and 9.0 or less with the pH adjuster, and a material of a member constituting the first cap device and the third cap device is aluminum or an aluminum alloy.

The ink jet recording apparatus of Application Example 8 is capable of decreasing corrosion of the member constituting the first cap device and the third cap device.

Application Example 9

In the ink jet recording apparatus of any one of Application Examples 1 to 8, the maintenance liquid may further contain a water-soluble colorant.

The ink jet recording apparatus of Application Example 9 is capable of using a maintenance liquid with excellent visibility.

Application Example 10

A maintenance liquid for an ink jet recording apparatus according to an embodiment of the present invention is a maintenance liquid used for an ink jet recording apparatus including an ejection head which ejects an aqueous ink composition containing a resin component, a water-soluble organic solvent having a boiling point of 250° C. or less, a surfactant, and water; a cap device which covers and moisturizes the ejection head; and a maintenance liquid supply device which supplies a maintenance liquid to the cap device. The maintenance liquid contains water and at least one water-soluble organic solvent of alkanediols having a boiling point of 250° C. or less and alkylene glycol monoether derivatives having a boiling point of 250° C. or less.

According to the maintenance liquid for the ink jet recording apparatus of Application Example 10, even when an aqueous ink composition which is easy to dry is used, the ejection head can be sufficiently moisturized because the maintenance liquid can be supplied to the cap device. In addition, the number of maintenance works for the cap device can be decreased because of the excellent antiseptic properties of the maintenance liquid.

Application Example 11

In Application Example 10, the content of the water-soluble organic solvent in the maintenance liquid is 0.05% by mass or more and 5% by mass or less.

According to the maintenance liquid for the ink jet recording apparatus of Application Example 11, the moisturizing performance of the maintenance liquid can be effectively improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Preferred embodiments of the present invention are described below. In the embodiments, examples of the present invention are described. In addition, the present invention is not limited to the embodiments and includes various modification examples carried out within a range where the gist of the invention is not changed.

1. First Embodiment

1.1. Ink Jet Recording Apparatus

An ink jet recording apparatus according to an embodiment of the present invention includes an ejection head which ejects an aqueous ink composition containing a resin component, a water-soluble organic solvent having a boiling point of 250° C. or less, a surfactant, and water; a first cap device which covers and moisturizes the ejection head; and a first maintenance liquid supply device which supplies a maintenance liquid to the first cap device, the maintenance liquid containing water and at least one water-soluble organic solvent of alkanediols having a boiling point of 250° C. or less and alkylene glycol monoether derivatives having a boiling point of 250° C. or less.

Figure 1:
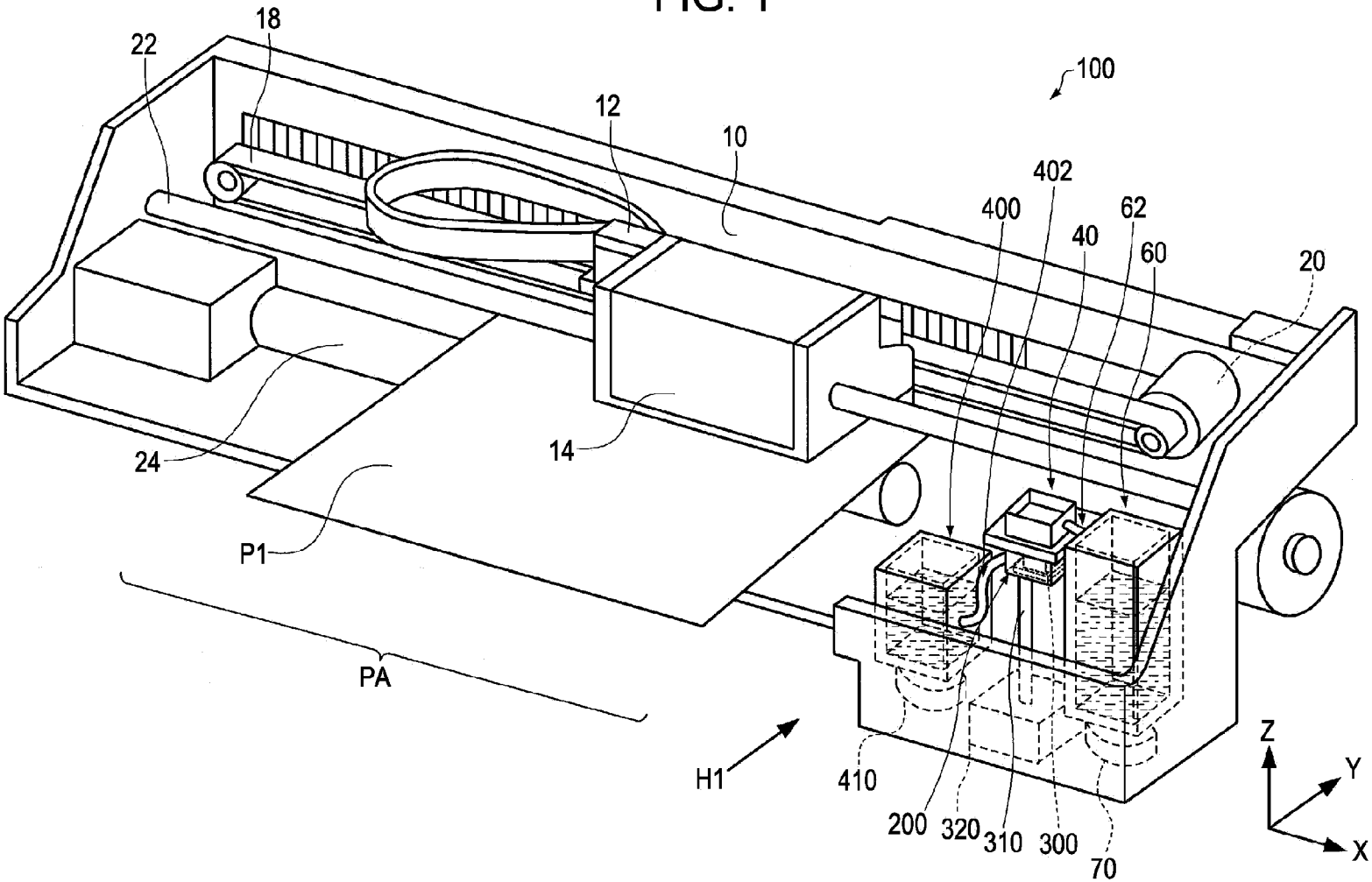
FIG. 1 is an explanatory view showing a schematic configuration of an ink jet recording apparatus according to a first embodiment.

FIG. 1 is a schematic view showing an example of the ink jet recording apparatus according to the embodiment. In the example shown in FIG. 1, an ink jet recording apparatus 100 includes a frame 10 on which a platen 24 is disposed. A paper feed mechanism (not shown) is provided on the platen 24 so that printing paper P1 is transferred.

The ink jet recording apparatus according to the embodiment may include a carriage. In the example shown in FIG. 1, a carriage 12 is supported so as to be movable in the longitudinal direction (X-axis direction) of the platen 24 through a guide member 22 and is reciprocated by a carriage motor 20 through a timing belt 18.

In the example shown in FIG. 1, an ink cartridge 14 is mounted on the carriage 12. In addition, an ejection head not shown (also simply referred to as a "head" hereinafter) is mounted on the lower side of the carriage 12. The carriage 12 is moved along the platen 24 to transfer the head (not shown) so that the head reciprocates on the printing paper P1. At this time, printing is performed by ejecting an ink from the head (not shown).

In the example shown in FIG. 1, an area on the side of an area (referred to as a "printing area" hereinafter) PA where an ink can be ejected from the head (not shown) in the frame 10 is a non-printing area where an ink is not ejected, and a home position H1 is provided in the non-printing area. The carriage 12 is configured to be movable between the printing area PA and the home position H1.

The ink jet recording apparatus according to the embodiment includes a first cap device and a first maintenance liquid supply device. In the example shown in FIG. 1, a first cap device 40 is disposed at the home position H1. The first maintenance liquid supply device includes a first maintenance liquid tank 60, a tube 62, and a first maintenance liquid lifting unit 70, which are disposed at the home position H1.

The ink jet recording apparatus according to the embodiment may further include a second cap device, a suction device, a third cap device, and a second maintenance liquid supply device. In the example shown in FIG. 1, a second cap device 300, a suction device 320, and a third cap device 200 are disposed at the home position H1. The second maintenance liquid supply device includes a second maintenance liquid tank 400, a tube 402, and a second maintenance liquid lifting unit 410, which are disposed at the home position H1.

The first cap device 40 is disposed to cover an ejection surface of the head in a power-off state for the reason below. After printing, flushing (apart from printing, treatment of removing thickened ink etc. by ejecting a predetermined amount of ink from all nozzles), or suction recovery (treatment of sucking an ink remaining in the head), ink droplets may remain adhering to the ejection surface and in the nozzles of the head (not shown). In this case, when the ink adhering to the ejection surface etc. is dried, nozzle orifices are clogged to possibly cause defective ejection. Therefore, in order to prevent drying of the ink adhering to the ejection surface etc., with the power tuned off, the head (not shown) is disposed at the home position, and the ejection surface of the head (not shown) is covered with the first cap device 40.

A maintenance liquid is stored in the first maintenance liquid tank 60. The first maintenance liquid tank 60 supplies the maintenance liquid (described below) to the first cap device 40 in order to moisturize the head. The head is moisturized by being covered with the first cap 40, but the head can be more effectively moisturized by supplying the maintenance liquid (described below) into the first cap device 40.

On the other hand, the second cap device 300 is disposed so as to cover the ejection surface of the head (not shown) during flushing or suction recovery and to receive the ink discharged from the head (not shown). The ink jet recording apparatus 100 may be provided with at least one of the flushing and the suction recovery.

The suction device 320 is connected to the second cap device 300 through a suction tube 310 so as to perform suction recovery for removing the ink in the head (not shown) by suction and to remove the ink discharged to the second cap device 300. The suction device 320 is capable of forcibly ejecting and discharging residual ink in the head (not shown) due to a negative pressure in the second cap device 300 and sucking the ink discharged to the second cap device 300.

The third cap device 200 is adapted for moisturizing the second cap device 300. The second cap device 300 is moisturized for the reason below. When the second cap device 300 is not moisturized, the ink ejected in the second cap device 300 may be dried and thickened during suction recovery or flushing. This may bring about clogging in an ink-absorbing member (sponge or the like) disposed in the second cap device 300 or in the suction tube 310, thereby causing a decrease in ink adsorption force or suction force. In particular, when an aqueous ink composition which has the drying property improved for printing on a plastic film described below is used, the residual ink in the second cap device 300 may be dried and solidified by being opened to air within a short time of several hours for which the ink jet recording apparatus is operated. Therefore, the second cap device 300 is preferably moisturized.

A maintenance liquid is stored in the second maintenance liquid tank 400. The second maintenance liquid tank 400 supplies the maintenance liquid (described below) to the third cap device 200 in order to moisturize the second cap device 300. The maintenance liquid (described below) used in the second maintenance liquid tank 400 may be the same as that (described below) used in the first maintenance liquid tank 60.

Figure 2:
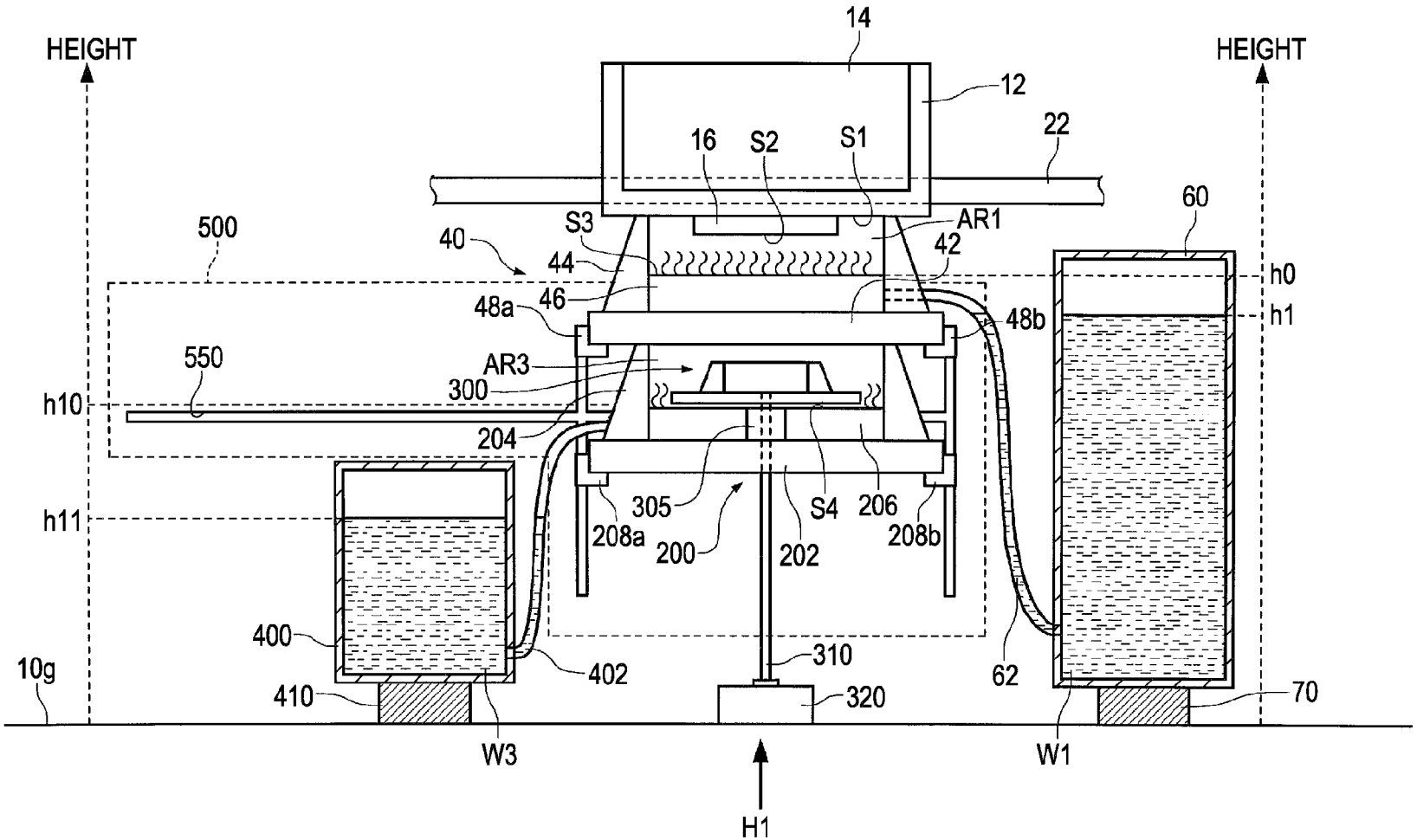
FIG. 2 is an explanatory view showing a detailed configuration near a home position H1 in a power-off state of the ink jet recording apparatus shown in FIG. 1.

FIG. 2 is a sectional view showing a configuration near the home position H1 in a power-off state. In a power-off state of the printer 100, the carriage 12 is disposed at the home position H1. Even in a power-on state, under a (standby) condition in which printing or flushing is not carried out, the carriage 12 and the first cap device 40 are disposed as shown in FIG. 2.

In an example shown in FIG. 2, the first maintenance liquid tank 60 is connected to the first cap device 40 through the tube 62. One of the ends of the tube 62 is connected to the inside of the first maintenance liquid tank 60 so that the liquid W1 stored in the first maintenance liquid tank 60 enters the tube 62. In this case, the water head of the liquid W1 stored in the first maintenance liquid tank 60 is at a height h1 from the frame bottom 10*g*. The first maintenance liquid tank elevating unit 70 is disposed below the first maintenance liquid tank 60. The first maintenance liquid tank elevating unit 70 adjusts the position of the first maintenance liquid tank 60 so that the head of the stored liquid W1 is kept at substantially the height h1 even when the stored liquid W1 in the first maintenance liquid tank 60 is lowered by supply to the first cap device 40. The first maintenance liquid tank elevating unit 70 may be composed of, for example, a spring. In this case, since the total weight of the first maintenance liquid tank 60 decreases as the amount of the stored liquid W1 decreases, the whole of the first maintenance liquid tank 60 rises so that the position of the water head can be kept at the height h1.

In the example shown in FIG. 2, the first cap device 40 includes a cap holder 42, a cap portion 44 disposed on the cap holder 42 to project in the Z-axis direction, and a sheet-shaped absorber 46 disposed at the bottom of a space surrounded by the cap portion 44. The first cap device 40 is supported at the bottom by two supporting members 48*a* and 48*b*. The two supporting members 48*a* and 48*b* are connected to a moving mechanism 500 through a sliding hole 550 provided in the frame 10 (FIG. 1) so that the first cap device 40 can be vertically and horizontally moved by vertically and horizontally sliding the two supporting members 48*a* and 48*b* with the moving mechanism 500. The moving mechanism 500 is disposed at the back of the sliding hole 550 (outside the frame 10).

For example, when the carriage 12 is returned from the print area PA to the home position H1 and transferred to a standby state after the completion of printing, the first cap device 40 is raised by raising the supporting members 48*a* and 48*b*. Therefore, the cap portion 44 abuts on the bottom S1 of the carriage 12, forming a substantially closed space AR1 surrounded by the bottom S1, the cap portion 44, and the absorber 46. At this time, the maintenance liquid is contained in the absorber 46 and is evaporated to humidify the space AR1. Therefore, drying the ink remaining on the ejection surface S2 and in nozzles (not shown) of the head 16 can be prevented, and thus thickening of the residual ink can be suppressed.

In the power-off state (standby state), the height h0 of the upper surface S3 of the absorber 46 is higher than the height h1 of the water head of the stored liquid W1 in the maintenance liquid tank 60. Therefore, in this state, the stored liquid W1 is not supplied as a liquid to the first cap device 40 from the maintenance liquid tank 60. However, the stored liquid W1 entering the tube 62 is evaporated and a small amount of the maintenance liquid is supplied to the absorber 46.

The cap portion 44 may be composed of, for example, synthetic rubber. One of the ends of the tube 62 passes through the cap portion 44 and reaches the absorber 46. As the absorber 46, for example, any member such as a urethane or PVA (polyvinyl alcohol) sponge or nonwoven fabric, which can absorb and hold water, can be used. In addition, the first cap device 40 need not necessarily be provided with the sheet-shaped absorber 46 so that the maintenance liquid may be supplied directly to the first cap device 40.

The first cap device 40 may further include a heating device which heats the maintenance liquid (described below) supplied into the first cap device 40. Therefore, the maintenance liquid can be more effectively evaporated and the space AR1 can be more efficiently moisturized. The position where the heating device is provided is not particularly limited as long as the maintenance liquid supplied to the first cap device 40 can be sufficiently heated. As the heating device, a device including a known heating mechanism, for example, an electric heating heater, can be used. In this case, at least a portion of a member constituting the first cap device 40 is preferably composed of aluminum or an aluminum alloy from the viewpoint of heat resistance and thermal conductivity.

In addition, the first cap device 40 may further include an optical sensor in order to detect the amount of the maintenance liquid (described below) supplied to the first cap device 40. Thus, the amount of the maintenance liquid in the first cap device 40 can be accurately controlled. The position where the optical sensor is provided is not particularly limited as long as the amount of the maintenance liquid in the first cap device 40 can be detected. Further, an absorption wavelength of a colorant added to the maintenance liquid and combination of a light-emitting element and light-receiving element constituting the optical sensor are appropriately selected, so that not only the amount of the maintenance liquid can be detected, but also deterioration of the maintenance liquid due to concentration of the colorant which is caused by evaporation of water component in the maintenance liquid, addition of a liquid (only water) other than the maintenance liquid, or the like can be specified by the intensity of light received by the light-receiving element. As the optical sensor, a known optical sensor, for example, a reflection-type photosensor, a regressive reflection-type photosensor, or a separate-type photosensor, can be used.

In the example shown in FIG. 2, the third cap device 200 has substantially the same configuration as the first cap device 40. That is, the third cap device 200 includes a cap holder 202, a cap portion 204, and an absorber 206. A supporting member 305 is disposed at the center of the absorber 206, and the second cap device 300 is disposed on the supporting member 305. In addition, the third cap device 200 need not necessarily be provided with the sheet-shaped absorber 206 so that the maintenance liquid is directly supplied into the third cap device 200.

The configuration of the second cap device 300 is same as that of the first cap device 40 except that the second cap device 300 is connected to a suction device 320, not connected to a maintenance liquid tank.

In the example shown in FIG. 2, like the first cap device 40, the third cap device 200 is supported at the bottom by two supporting members 208*a* and 208*b*. The two supporting members 208*a* and 208*b* are connected to the moving mechanism 500 through the sliding hole 550. The moving mechanism 500 can vertically move the third cap device 200 by vertically sliding the two supporting members 208*a* and 208*b*.

The maintenance liquid serving as a moisturizer is stored as stored liquid W3 in the second maintenance liquid tank 400. Like the first maintenance liquid tank 60, the second maintenance liquid tank 400 is connected to the third cap device 200 (the absorber 206) through a tube 402. In addition, a second maintenance liquid tank elevating unit 410 is disposed below the second maintenance liquid tank 400. Like the first maintenance liquid tank elevating unit 70, the second maintenance liquid tank elevating unit 410 can adjust the position of the second maintenance liquid tank 400 so that the water head of the stored liquid W3 in the second maintenance liquid tank 400 is kept substantially at a height h11.

In the power-off state and the standby state, the third cap device 200 abuts on the bottom of the first cap device 40 (bottom of the cap holder 42) by the cap portion 204. Therefore, a substantially closed space AR3 surrounded by the bottom of the cap holder 42, the cap portion 204, and the absorber 206 is formed. The space AR3 is moisturized by evaporation of the water absorbed in the absorber 206, so that drying of the ink ejected in the second cap device 300 can be suppressed. In the power-off state (standby state), since the height h10 of the top S4 of the absorber 206 is higher than the height h11 of the head of the stored water W3 in the second maintenance liquid tank 400, the stored water W3 is not supplied from the second maintenance liquid tank 400 to the absorber 206.

In addition, the third cap device 200 may further include a heating device which heats the maintenance liquid (described below) supplied into the third cap device 200. Consequently, the maintenance liquid can be more effectively evaporated, and the space AR3 can be more efficiently moisturized. The position where the heating device is provided is not particularly limited as long as the maintenance liquid supplied to the third cap device 200 can be sufficiently heated. The same heating device as in the first cap device 40 can be used in the third cap device 200. In this case, at least a portion of a member constituting the third cap device 200 is preferably composed of aluminum or an aluminum alloy from the viewpoint of heat resistance and thermal conductivity.

In addition, the third cap device 200 may further include an optical sensor in order to detect the amount of the maintenance liquid (described below) supplied to the third cap device 200. Thus, the amount of the maintenance liquid in the third cap device 200 can be accurately controlled. The position where the optical sensor is provided is not particularly limited as long as the amount of the maintenance liquid in the third cap device 200 can be detected. Further, an absorption wavelength of a colorant added to the maintenance liquid and combination of a light-emitting element and light-receiving element constituting the optical sensor are appropriately selected, so that not only an amount of the maintenance liquid can be detected, but also deterioration of the maintenance liquid due to concentration of the colorant which is caused by evaporation of water component in the maintenance liquid, addition of a liquid (e.g., only water) other than the maintenance liquid, or the like can be specified by the intensity of light received by the light-receiving element. As the optical sensor, a known optical sensor, for example, a reflection-type photosensor, a regressive reflection-type photosensor, or a separate-type photosensor, can be used.

Figure 3:
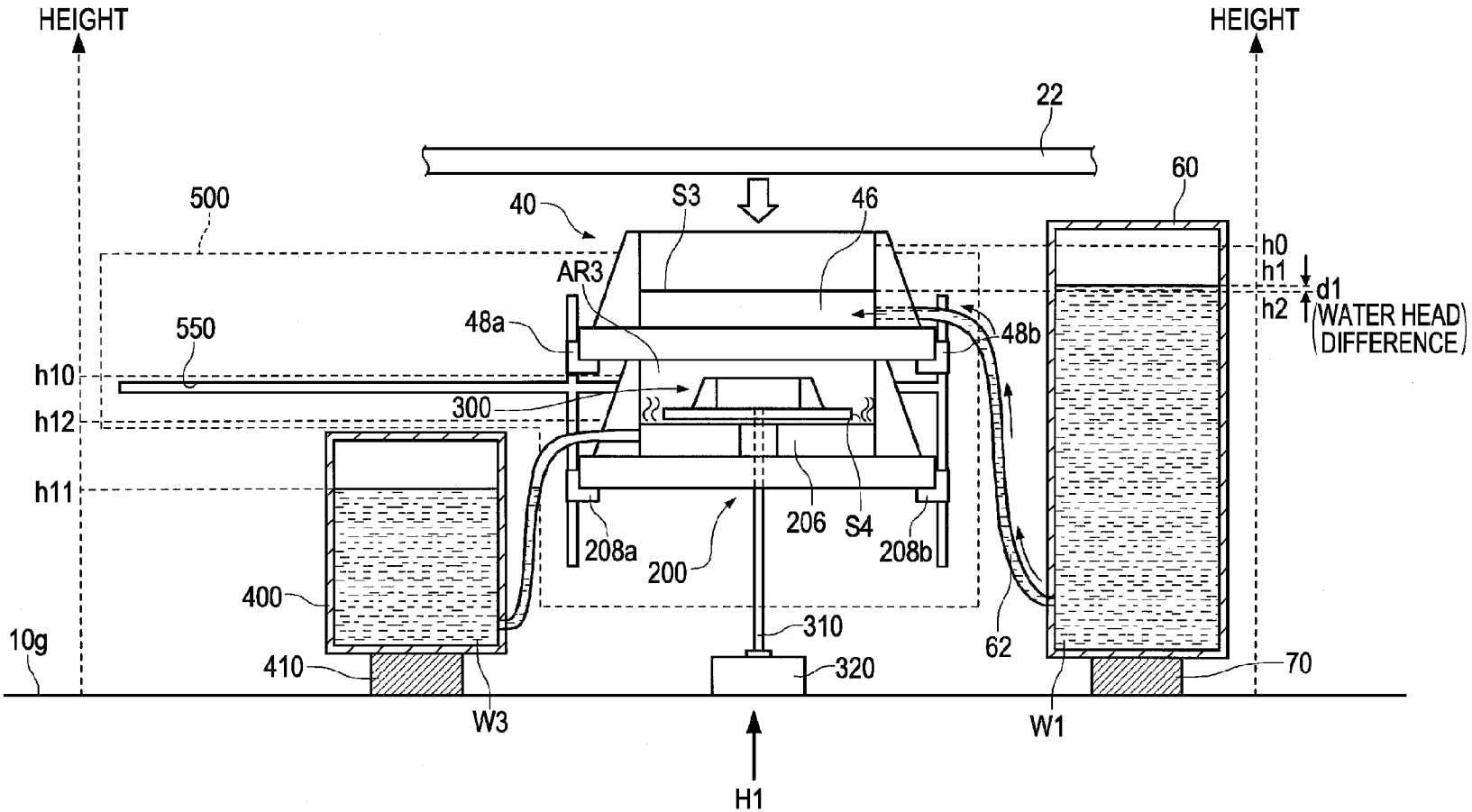
FIG. 3 is an explanatory view showing a detailed configuration near a home position H1 during printing in the ink jet recording apparatus shown in FIG. 1.

FIG. 3 is an explanatory view showing a detailed configuration near the home position H1 during printing. At the start of printing, the moving mechanism 500 simultaneously lowers the first cap device 40 and the third cap device 200 at the same speed. As a result, the space AR3 is not opened to maintain the humidity in the space AR3. At this time, the moving mechanism 500 lowers the first cap device 40 (and the third cap device 200) so that the height h2 of the top S3 of the absorber 46 of the first cap device 40 is lower than the height h1 of the head of the stored liquid W1 in the first maintenance liquid tank 60. Therefore, a water head difference d1 (h1−h2) occurs between the absorber 46 and the head of the stored liquid W1 in the first maintenance liquid tank 60, thereby supplying the stored liquid W1 from the first maintenance liquid tank 60 to the first cap device 40.

At this time, in the third cap device 200, the position of the top S4 of the absorber 206 is at a height h12 higher than the height h11 of the head of the stored liquid W3 in the second maintenance liquid tank 400. Therefore, the stored liquid W3 is not supplied from the second maintenance liquid tank 400 to the third cap device 200.

Figure 4:
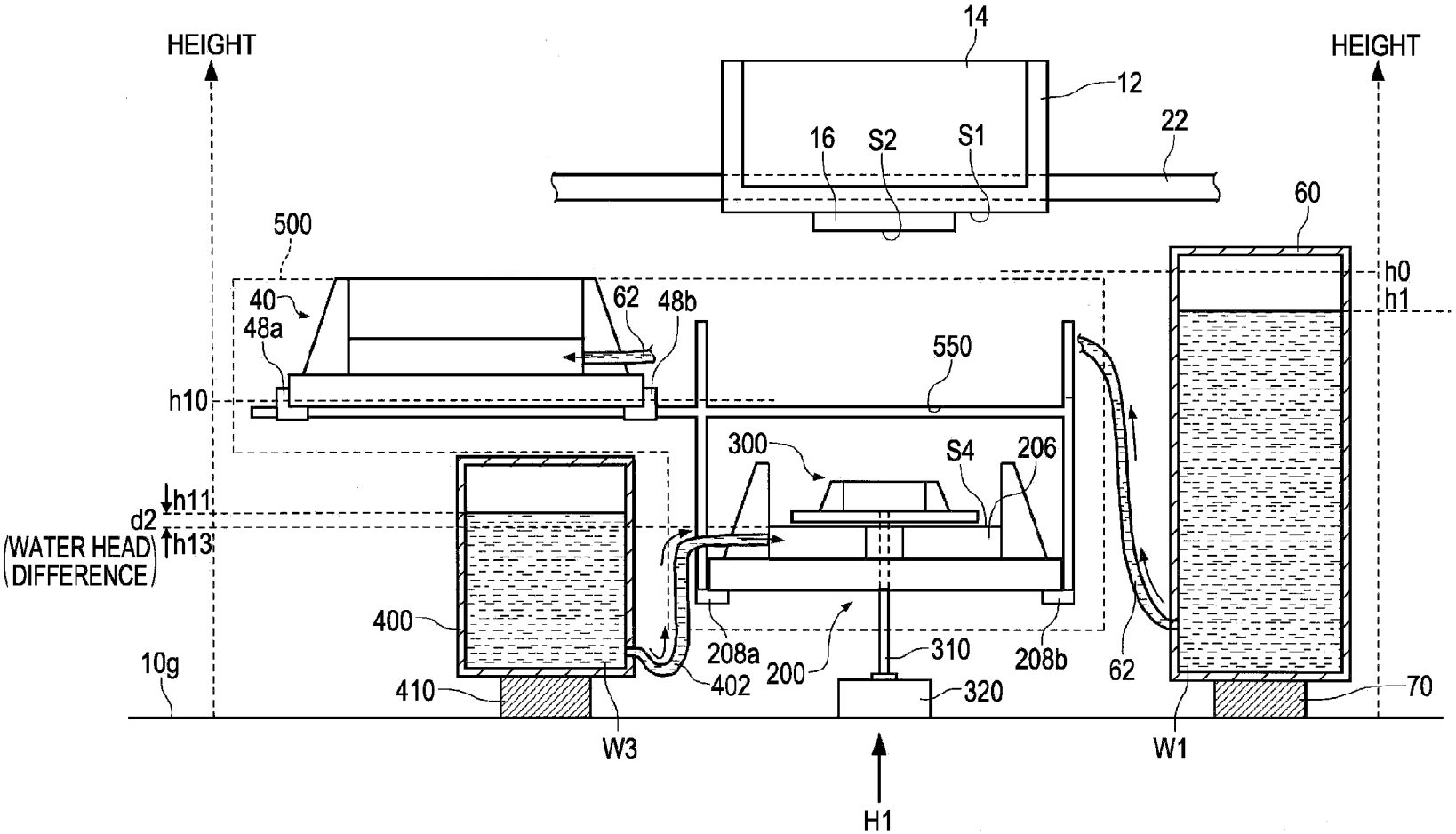
FIG. 4 is an explanatory view showing a detailed configuration near a home position H1 during suction recovery in the ink jet recording apparatus shown in FIG. 1.

FIG. 4 is an explanatory view showing a detailed configuration near the home position H1 during suction recovery. When the standby state (FIG. 2) is transferred to suction recovery, the moving mechanism 500 first slightly lowers the first cap device 40 and the third cap device 200. Then, the moving mechanism 500 moves the first cap device 40 to the left from the home position H1 and further lowers the third cap device 200 at the home position H1. At this time, the moving mechanism 500 lowers the third cap device 200 so that the height h13 of the top S4 of the absorber 206 is lower than the height h11 of the head of the stored liquid W3 in the second maintenance liquid tank 400. As a result, a water head difference d2 (h11−h13) occurs between the absorber 206 and the stored liquid W3 in the second maintenance liquid tank 400, thereby supplying the stored liquid W3 from the second maintenance liquid tank 400 to the third cap device 200 (absorber 206).

Figure 5:
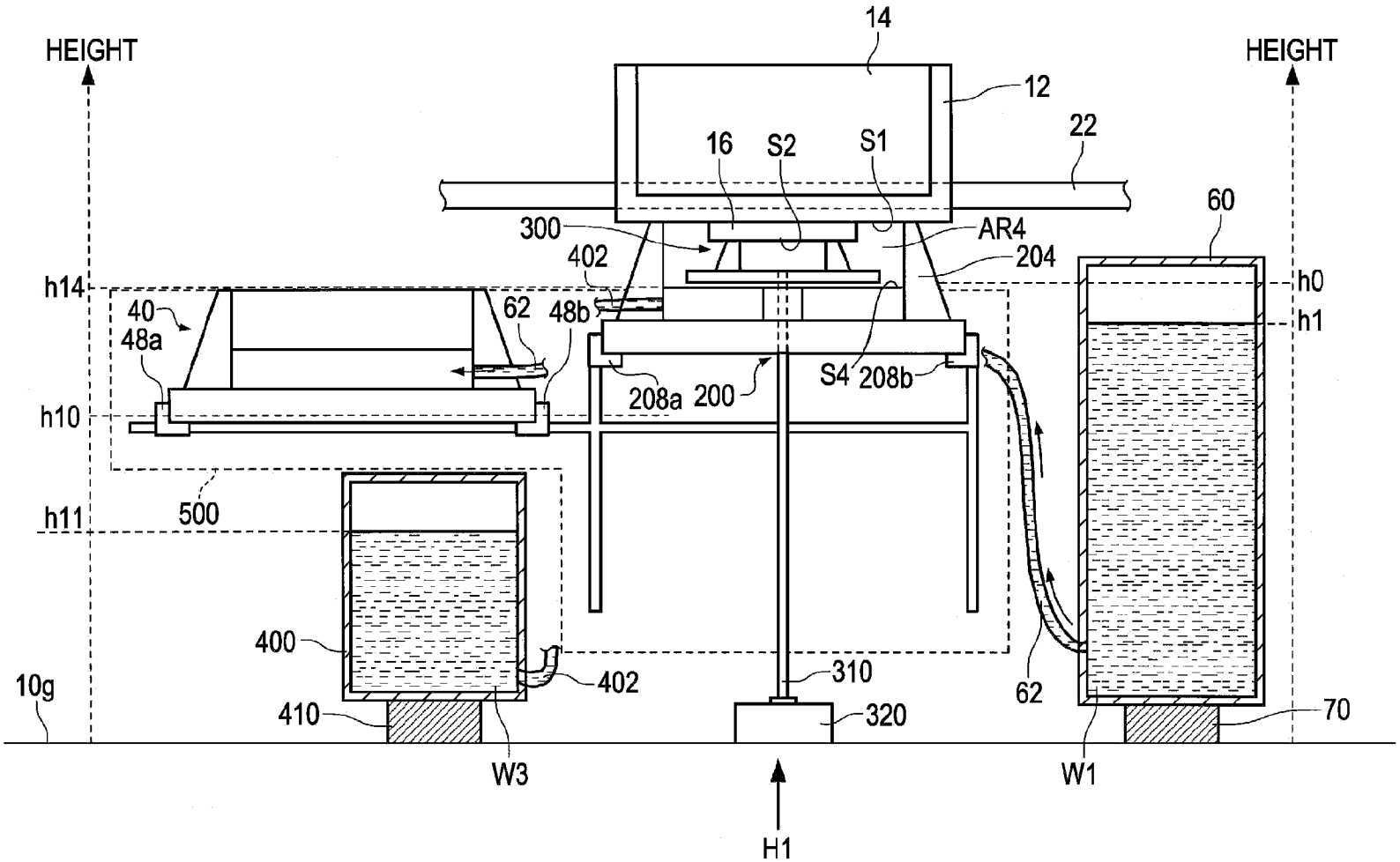
FIG. 5 is an explanatory view showing a detailed configuration near a home position H1 during suction recovery in the ink jet recording apparatus shown in FIG. 1.

FIG. 5 is an explanatory view showing a detailed configuration near the home position H1 during suction recovery. FIG. 5 shows a state at a time after the state shown in FIG. 4. After the moving mechanism 500 lowers the third cap device 200 to the position shown in FIG. 4 to supply the stored liquid W3 to the absorber 206, the third cap device 200 is raised. When the cap portion 204 of the third cap device 200 abuts on the bottom S1 of the carriage 12, the moving mechanism 500 stops raising the third cap device 200. At this time, a substantially closed space AR4 surrounded by the bottom S1 of the carriage 12, the cap portion 204, and the absorber 206 is formed. Then, the suction device 320 sucks the residual ink from the nozzles (not shown) of the head 16 due to a negative pressure in the second cap device 300. In this case, the height h14 of the top S4 of the absorber 206 is higher than the height h11 of the head of the stored liquid W3 in the second maintenance liquid tank 400, and thus the stored liquid W3 is not supplied to the absorber 206.

As described above, the stored liquid W1 can be supplied to the first cap device 40 by using the water head difference d1 between the stored liquid W1 in the first maintenance liquid tank 60 and the absorber 46. Therefore, in the ink jet recording apparatus 100, when the first cap device 40 is lowered before the carriage 12 is moved for printing, the top S3 of the absorber 46 is at a position lower than the head of the stored liquid W1 in the first maintenance liquid tank 60. Therefore, a water head difference occurs between the absorber 46 and the stored liquid W1, so that the stored liquid W1 can be supplied to the absorber 46 by using the water head difference. As a result, a large amount of the maintenance liquid can be supplied to the first cap device 40, and the space AR1 in the first cap device 40 can be sufficiently moisturized.

In addition, the second cap device 300 is moisturized by being covered with the third cap device 200 during printing as well as in the power-off state (standby state). Therefore, during suction recovery, drying of the ink ejected in the second cap device 300 can be suppressed, thereby suppressing a decrease in ink adsorption force in the second cap device 300 and a decrease in suction force of nozzles. In addition, the stored liquid W3 can be supplied to the third cap device 200 by using the water head difference d2 between the stored liquid W3 in the second maintenance liquid tank 400 and the absorber 206, thereby sufficiently moisturizing the spaces AR3 and AR4 in the third cap device 200.

1.2. Maintenance Liquid

The maintenance liquid used in the ink jet recording apparatus according to the embodiment contains a water-soluble organic solvent having a boiling point of 250° C. or less and water. The maintenance liquid used in the ink jet recording apparatus according to the present invention is described in detail below.

(1) Water-Soluble Organic Solvent

The maintenance liquid used in the ink jet recording apparatus according to the embodiment contains at least one water-soluble organic solvent selected from alkanediols having a boiling point of 250° C. or less and alkylene glycol monoether derivatives having a boiling point of 250° C. or less. The alkanediols and alkylene glycol monoether derivatives can enhance not only the moisture retaining ability of the maintenance liquid but also the antiseptic ability of the maintenance liquid. Since the maintenance liquid has excellent antiseptic ability, the number of maintenance works such as cleaning in a cap device can be decreased.

By using an alkanediol having a boiling point of 250° C. or less or an alkylene glycol monoether derivative having a boiling point of 250° C. or less, even when the water-soluble organic solvent is concentrated by evaporation of water contained in the maintenance liquid in a cap device, moisture of an aqueous ink composition (described below) adhering near the ejection head is little absorbed. Therefore, thickening of the aqueous ink composition (described below) near the ejection head can be prevented, and thus ejection stability of the ejection head can be improved.

The maintenance liquid containing the organic solvent has lower surface tension than a maintenance liquid containing only water, and thus wettability of a tube used for supplying the maintenance liquid to the cap device is increased. Consequently, the supply performance of the maintenance liquid can be improved.

Examples of the alkanediols include 1,2-propanediol (boiling point; 188° C.), 1,2-pentanediol (boiling point; 206° C.), 1,2-hexanediol (boiling point; 223° C.), 1,6-hexanediol (boiling point; 250° C.), 2,2-dimethylpropane-1,3-diol (neopentyl glycol) (boiling point; 210° C.), and the like.

Examples of the alkylene glycol monoether derivatives include ethylene glycol monomethyl ether (boiling point; 125° C.), diethylene glycol monomethyl ether (boiling point; 193° C.), ethylene glycol monobutyl ether (boiling point; 171° C.), diethylene glycol monobutyl ether (boiling point; 230° C.), propylene glycol monomethyl ether (boiling point; 121° C.), and the like.

The content of the water-soluble organic solvent is preferably 0.05% by mass or more and 5% by mass or less, more preferably 0.1% by mass or more and 5% by mass or less, and most preferably 1% by mass or more and 5% by mass or less based on the total mass of the maintenance liquid. When the content of the water-soluble organic solvent is less than 0.05% by mass, the moisture retaining ability of the maintenance liquid may not be obtained. On the other hand, when the content of the water-soluble organic solvent exceeds 5.0% by mass, the water-soluble organic solvent remaining after evaporation of moisturizing water is gradually accumulated, and thus a head and a member constituting the periphery of the head may be corroded by the concentrated water-soluble organic solvent.

The maintenance liquid used in the ink jet recording apparatus according to the embodiment preferably does not contain a water-soluble organic solvent having a boiling point exceeding 250° C. The organic solvent having a boiling point exceeding 250° C. may absorb water in an aqueous ink composition described below, thereby thickening the aqueous ink composition near the ejection head. This may decrease the ejection stability of the ejection head.

Examples of the solvent having a boiling point exceeding 250° C. include glycerin. When a cap device containing the maintenance liquid which contains a high-boiling-point organic solvent with high moisture absorbability, such as glycerin, is allowed to stand for a long time, the glycerin in the cap is concentrated by evaporation of water from the maintenance liquid in the cap. When such concentrated glycerin is present in the cap, water is absorbed from the aqueous ink composition adhering to the head and the cap device, thereby causing clogging of the head or operation error of the cap device. In addition glycerin has low antiseptic ability and easily propagates molds or fungi, and thus it is preferred that the maintenance liquid does not contain glycerin.

(2) Water

The maintenance liquid used in the ink jet recording apparatus according to the embodiment contains water. Water is a main component for exhibiting the moisture retaining ability of the maintenance liquid. The water content is preferably 95% by mass or more, more preferably 99% by mass or more, based on the total mass of the maintenance liquid.

(3) pH adjuster

The maintenance liquid used in the ink jet recording apparatus according to the embodiment may contain a pH adjuster. Although described in detail below, when pH is controlled by adding the pH adjuster to the maintenance liquid according to the material of a member constituting a cap device, corrosion of the member constituting the cap device can be prevented. For example, when the material constituting the cap device is aluminum or an aluminum alloy, the cap device may be corroded with the strongly acidic or strongly alkaline maintenance liquid. However, pH is adjusted to a range of 5.0 or more and 9.0 or less by adding the pH adjuster, so that corrosion of the cap device can be prevented.

Preferred examples of the pH adjuster include alcoholamines such as triisopropanolamine, triethanolamine, triisopropanolamine, and the like.

(4) Water-Soluble Colorant

The maintenance liquid used in the ink jet recording apparatus according to the embodiment may contain a water-soluble colorant. The water-soluble colorant is added for coloring the maintenance liquid. By coloring the maintenance, whether or not the maintenance liquid is filled in a necessary amount in the cap device is easily detected by a detection unit using an optical sensor. In addition, when a trouble such as leakage of the maintenance liquid occurs, a cause is easily specified because of the excellent visibility.

The type of the color of the water-soluble colorant is not particularly limited as long as the maintenance liquid can be colored. The water-soluble colorant is preferably a dye, for example, a direct dye, an acidic dye, a basic dye, or the like.

When the water-soluble colorant is added to the maintenance liquid, the content of the water-soluble colorant is preferably 0.0001% by mass or more and 1.0% by mass or less and more preferably 0.0005% by mass or more and 0.1% by mass or less based on the total mass of the maintenance liquid. When the content of the water-soluble colorant is less than 0.0001% by mass, coloring of the maintenance liquid is insufficient. On the other hand, when the content of the water-soluble colorant exceeds 1.0% by mass, the water-soluble colorant remaining after evaporation of water used for moisturizing may deposit in a cap device and impair the function of the cap device.

(5) pH

The pH of the maintenance liquid used in the ink jet recording apparatus according to the embodiment can be arbitrarily determined according to the member constituting a cap device. However, when the member is composed of aluminum or an aluminum alloy, the pH is preferably in the range of 5.0 or more and 9.0 or less. When the pH is set in the range of 5.0 or more and 9.0 or less, corrosion of the cap device including the member which is composed of aluminum or an aluminum alloy can be prevented.

1.3. Aqueous Ink Composition

The water-soluble ink composition used in the ink jet recording apparatus according to the embodiment contains a resin component, a water-soluble organic solvent having a boiling point of 250° C. or less, a surfactant, and water.

Since such a water-soluble ink composition has the very good ink drying property, it can be preferably used for printing on non-ink-absorbing or low-ink-absorbing recording media.

Since the water-soluble ink composition has the good drying property, when the head is not appropriately moisturized in a non-printing state, the residual ink near the head may be thickened, causing clogging and unsatisfactory ink ejection. Therefore, the troubles caused by the aqueous ink composition can be resolved by using the ink jet recording apparatus according to the embodiment.

The components contained in the aqueous ink composition according to the embodiment are described below.

(1) Colorant

The aqueous ink composition used in the ink jet recording apparatus according to the embodiment may contain a colorant. As the colorant, a dye or a pigment can be used, and a pigment is preferably used because it has the property of being little subject to discoloration by light and gas. Therefore, an image formed with a pigment on a recording medium of plastic or the like has good water resistance, gas resistance, light resistance, and storage stability.

The pigment which can be used in the embodiment is not particularly limited, but an inorganic pigment or an organic pigment can be used. As the inorganic pigment, as well as titanium oxide and iron oxide, carbon black produced by a known method, such as a contact method, a furnace method, or a thermal method, can be used. As the organic pigment, an azo pigment (an azo lake, an insoluble azo pigment, a condensed azo pigment, chelate azo pigment, or the like), a polycyclic pigment (e.g., a phthalocyanine pigment, a perylene pigment, a perinone pigment, an anthraquinone pigment, a quinophthalone pigment, or the like), a nitro pigment, a nitroso pigment, and aniline black can be used.

Specific examples of the pigment which can be used in the embodiment include carbon blacks such as furnace black, lamp black, acethylene black, channel black, and the like (C. I. Pigment Black 7), and commercial products such as No. 2300, 900, MCF88, No. 20B, No. 33, No. 40, No. 45, No. 52, MA7, MA8, MA77, MA100, No. 2200B and the like (trade name, manufactured by Mitsubishi Chemical Corporation); Color Black FW1, FW2, FW2V, FW18, FW200, S150, S160, and S170, Printex 35, U, V, and 140U, and Special Black 6, 5, 4A, 4, and 250 (trade name, manufactured by Degussa Corporation); Conductex SC and Raven 1255, 5750, 5250, 5000, 3500, 1255, and 700 (trade name, manufactured by Columbia Carbon Inc.); and Regal 400R, 330R, and 660R, Mogul L, Monarch 700, 800, 880, 900, 1000, 1100, 1300, and 1400, Elftex 12, and the like (trade name, manufactured by Cabot Corporation).

When the aqueous ink composition according to the embodiment is used as a yellow ink, examples of a pigment which can be used include C. I. Pigment Yellow 1, 2, 3, 12, 13, 14, 16, 17, 73, 74, 75, 83, 93, 95, 97, 98, 109, 110, 114, 120, 128, 129, 138, 150, 151, 154, 155, 180, 185, and 213.

When the aqueous ink composition according to the embodiment is used as a magenta ink, examples of a pigment which can be used include C. I. Pigment Red 5, 7, 12, 48 (Ca), 48 (Mn), 57 (Ca), 57:1, 112, 122, 123, 168, 184, 202, and 209, C. I. Pigment Violet 19, and the like.

When the aqueous ink composition according to the embodiment is used as a cyan ink, examples of a pigment which can be used include C. I. Pigment Blue 1, 2, 3, 15:3, 15:4, 16, 22, and 60, and the like.

When the aqueous ink composition according to the embodiment is used as a green ink, examples of a pigment which can be used include C. I. Pigment Green 7, 8, 36, and the like.

When the aqueous ink composition according to the embodiment is used as an orange ink, examples of a pigment which can be used include C. I. Pigment Orange 43, 51, 66, and the like.

The content of the colorant in the aqueous ink composition is preferably 1.5% by mass or more and 10% by mass or less and more preferably 2% by mass or more and 7% by mass or less based on the total mass of the aqueous ink composition.

In order to apply the pigment to the aqueous ink composition, it is necessary to stably disperse and hold the pigment in water. Examples of a dispersion method include a method of dispersing with a resin dispersant such as a water-soluble resin and/or a water-dispersible resin (hereinafter, the pigment dispersed by this method is referred to as the "resin-dispersed pigment"), a method of dispersing with a surfactant such as a water-soluble surfactant and/or a water-dispersible surfactant (hereinafter, the pigment dispersed by this method is referred to as the "surfactant-dispersed pigment"), and a method capable of dispersing and/or dissolving without using a dispersant such as the resin or the surfactant, by chemically or physically introducing hydrophilic functional groups to the surfaces of pigment particles (hereinafter, the pigment dispersed by this method is referred to as the "surface-treated pigment"). Any one of the resin-dispersed pigment, the surfactant-dispersed pigment, and the surface-treated pigment can be used for the aqueous ink composition used in the ink jet printing apparatus according to the embodiment, and these pigments can be used in combination of plural types of pigments according to demand.

Examples of the resin dispersant which can be used for the resin-dispersed pigment include polyvinyl alcohols, polyvinylpyrrolidones, polyacrylic acid, acrylic acid-acrylonitrile copolymers, vinyl acetate-acrylate copolymers, acrylic acid-acrylate copolymers, styrene-acrylic acid copolymers, styrene-methacrylic acid copolymers, styrene-methacrylic acid-acrylate copolymers, styrene-α-methylstyrene-acrylic acid copolymers, styrene-α-methylstyrene-acrylic acid-acrylate copolymers, styrene-maleic acid copolymers, styrene-maleic anhydride copolymers, vinylnaphthalene-acrylic acid copolymers, vinylnaphthalene-maleic acid copolymers, vinyl acetate-maleate copolymers, vinyl acetate-crotonic acid copolymers, vinyl acetate-acrylic acid copolymers, and the like; and salts thereof. Among these resins, particularly, a copolymer of a monomer having a hydrophobic functional group and a monomer having a hydrophilic functional group, and a polymer composed of a monomer having both a hydrophobic functional group and a hydrophilic functional group are preferred. As the form of a copolymer, any one of a random copolymer, a block copolymer, an alternating copolymer, and a graft copolymer can be used.

Examples of the salts include salts with basic compounds such as ammonia, ethylamine, diethylamine, triethylamine, propylamine, isopropylamine, dipropylamine, butylamine, isobutylamine, diethanolamine, triethanolamine, tri-iso-propanolamine, aminomethylpropanol, morpholine, and the like. The amount of the basic compound added is not particularly limited as long as it is the neutralization equivalent or more of the resin dispersant.

The molecular weight of the resin dispersant is preferably in a range of 1,000 to 100,000 and more preferably in a range of 3,000 to 10,000 in terms of the weight-average molecular weight. With the molecular weight within the above range, stable dispersion of the colorant in water can be achieved, and in application to the aqueous ink composition, the viscosity etc. can be easily controlled.

As the resin dispersant, a commercial product can also be used. Specific examples of the commercial product include Joncryl 67 (weight-average molecular weight: 12,500, acid value: 213), Joncryl 678 (weight-average molecular weight: 8,500, acid value: 215), Joncryl 586 (weight-average molecular weight: 4,600, acid value: 108), Joncryl 611 (weight-average molecular weight: 8,100, acid value: 53), Joncryl 680 (weight-average molecular weight: 4,900, acid value: 215), Joncryl 682 (weight-average molecular weight: 1,700, acid value: 238), Joncryl 683 (weight-average molecular weight: 8,000, acid value: 160), and Joncryl 690 (weight-average molecular weight: 16,500, acid value: 240) (all being trade names, manufactured by BASF Japan Co., Ltd.).

Examples of the surfactant used for the surfactant-dispersed pigment include anionic surfactants such as alkanesulfonic acid salts, α-olefinsulfonic acid salts, alkylbenzenesulfonic acid salts, alkylnaphthalenesulfonic acid salts, acylmethyl taurine acid salts, dialkylsulfosuccinic acid salts, alkylsulfuric acid ester salts, sulfonated olefins, polyoxyethylene alkyl ether sulfuric acid ester salts, alkylphosphoric acid ester salts, polyoxyethylene alkyl ether phosphoric acid ester salts, monoglyceride phosphoric acid ester salts, and the like; amphoteric surfactants, such as alkylpyridinium salts, alkyl amino acid salts, alkyldimethyl betaines, and the like; and nonionic surfactants, such as polyoxyethylene alkyl ethers, polyoxyethylene alkyl phenyl ethers, polyoxyethylene alkyl esters, polyoxyethylene alkyl amides, glycerin alkyl esters, sorbitan alkyl esters, and the like.

The amount of the resin dispersant or surfactant added to the pigment is preferably 1 part by mass to 100 parts by mass and more preferably 5 parts by mass to 50 parts by mass based on 100 parts by mass of the pigment. Within this range, dispersion stability of the pigment in water can be secured.

For the surface-treated pigment, hydrophilic functional groups include —OM, —COOM, —CO—, $—SO_3M$, $—SO_2NH_2$, $—RSO_2M$, $—PO_3HM$, $—PO_3M_2$, $—SO_2NHCOR$, $—NH_3$, and $—NR_3$ (wherein M represents a hydrogen atom, an alkali metal, ammonium, or organic ammonium, and R represents an alkyl group having 1 to 12 carbon atoms, a phenyl group which may be substituted, or a naphthyl group which may be substituted). Such a functional group is physically and/or chemically introduced to the surfaces of the pigment particles by grafting directly and/or through another group. Examples of a polyvalent group include an alkylene group having 1 to 12 carbon atoms, a phenylene group which may be substituted, a naphthylene group which may be substituted, and the like.

For the surface-treated pigment, the surfaces of the pigment particles are treated with a sulfur-containing treating agent so that $—SO_3M$ and/or $—RSO_2M$ (M represents a counter ion, such as a hydrogen ion, an alkali metal ion, an ammonium ion, or an organic ammonium ion) is chemically bonded to the particle surfaces. That is, preferably, the pigment is dispersed in a solvent which has no active proton and no reactivity with sulfonic acid and in which the pigment is insoluble or slightly soluble. Then, the surfaces of the pigment particles are treated with amidosulfuric acid or a complex of sulfur trioxide and tertiary amine so that $—SO_3M$ and/or $—RSO_2M$ is chemically bonded to the particle surfaces, thereby allowing the pigment to disperse and/or dissolve in water.

As the surface treatment method for grafting the functional group or a salt thereof to the surfaces of the pigment particles directly or through a polyvalent group, various known surface treatment methods can be used. Examples thereof include a method of treating commercial oxidized carbon black with ozone or a sodium hypochlorite solution and further oxidizing the carbon black to further hydrophilize the surfaces (for example, Japanese Unexamined Patent Application Publication Nos. 7-258578, 8-3498, 10-120958, 10-195331, and 10-237349), a method of treating carbon black with 3-amino-N-alkyl-substituted pyridinium bromide (for example, Japanese Unexamined Patent Application Publication Nos. 10-195360 and 10-330665), a method of dispersing an organic pigment in a solvent in which the organic pigment is insoluble or slightly soluble, and introducing sulfone groups to the surfaces of the pigment particles with a sulfonating agent (for example, Japanese Unexamined Patent Application Publication Nos. 8-283596, 10-110110, and 10-110111), and a method of dispersing an organic pigment in a basic solvent which forms a complex with sulfur trioxide and introducing a sulfone group or a sulfonamino group by surface-treating the organic pigment with sulfur trioxide added (Japanese Unexamined Patent Application Publication No. 10-110114). The method for forming the surface-treated pigment used in the present invention is not limited to these methods.

The type of the functional group grafted to one pigment particle may be single or multiple. The type of the functional group grafted and the degree of grafting may be appropriately determined in consideration of dispersion stability in ink, a color density, the drying property on the front surface of an ink jet head, etc.

As the method for dispersing the resin-dispersed pigment, the surfactant-dispersed pigment, or the surface-treated pigment in water, the resin-dispersed pigment, water, and the resin dispersant, the surfactant-dispersed pigment, water, and the surfactant, or the surface-treated pigment and water, and if required, a water-soluble organic solvent, a neutralizer, etc. are added, and the resultant mixture is dispersed with a generally used disperser such as a ball mill, a sand mill, an attritor, a roll mill, an agitator mill, a Henschel mixer, a colloid mill, an ultrasonic homogenizer, a jet mill, an angmill, or the like. In this case, in view of securing dispersion stability of the pigment in water, the pigment is preferably dispersed until the particle diameter of the pigment is in a range of 20 nm to 500 nm, more preferably in a range of 50 nm to 200 nm, in terms of the average particle diameter.

(2) Resin Component

The aqueous ink composition used in the ink jet recording apparatus according to the embodiment contains a water-soluble and/or water-insoluble resin component. The resin component has the function of solidifying an ink and strongly fixing the solidified ink to plastic media. The resin component may be in a state of being dissolved in the aqueous ink composition or a state of being dispersed in the aqueous ink composition. As the resin component in a dissolved state, the above-described resin dispersant used for dispersing the pigment as the colorant in the aqueous ink composition used in the ink jet recording apparatus according to the embodiment can be used. In addition, as the resin in a dispersed state, a resin component which is slightly soluble or insoluble in a liquid medium of the aqueous ink composition used in the ink jet recording apparatus according to the embodiment can be contained by dispersing in the form of fine particles (i.e., an emulsion state or suspension state).

Examples of the resin component include polyacrylic acid esters or copolymers thereof, polymethacrylic acid esters or copolymers thereof, polyacrylonitrile or copolymers thereof, polycyanoacrylate, polyacrylamide, polyacrylic acid, polymethacrylic acid, polyethylene, polypropylene, polybutene, polyisobutylene, polystyrene or copolymers thereof, petroleum resins, chroman-indene resins, terpene resins, polyvinyl acetate or copolymers thereof, polyvinyl alcohol, polyvinyl acetal, polyvinyl ether, polyvinyl chloride or copolymers thereof, polyvinylidene chloride, fluorocarbon resins, fluorocarbon rubber, polyvinylcarbazole, polyvinylpyrrolidone or copolymers thereof, polyvinyl pyridine, polyvinyl imidazole, polybutadiene or copolymers thereof, polychloroprene, polyisoprene, natural resins, and the like. Among these resins, a resin having both a hydrophobic portion and a hydrophilic portion in its molecular structure is preferred.

The resin component in the form of fine particles may be produced by any one of the methods described below, and, if required, a plurality of methods may be combined. The methods include a method of mixing a polymerization catalyst (polymerization initiator) and a dispersant with a monomer constituting a desired resin component, and performing polymerization (emulsion polymerization); a method of dissolving a resin component having a hydrophilic portion in a water-soluble organic solvent, mixing the resultant solution in water, and then removing the water-soluble organic solvent by distillation or the like; and a method of dissolving a resin component in a water-insoluble organic solvent and then mixing the resultant solution in an aqueous solution together with a dispersant. Any one of the methods can be appropriately selected according to the type and characteristics of the resin component used. Examples of the dispersant which can be used for dispersing the resin component include, but are not limited to, anionic surfactants (e.g., dodecylbenzene sulfonic acid sodium salt, lauryl phosphoric acid sodium salt, polyoxyethylene alkyl ester sulfate ammonium salt, and the like); and nonionic surfactants (e.g., polyoxyethylene alkyl ethers, polyoxyethylene alkyl esters, polyoxyethylene sorbitan fatty acid esters, polyoxyethylene alkyl phenyl ethers, and the like). These can be used alone or as a mixture of two or more.

When the resin component is used in the form of fine particles (emulsion state or suspension state), fine particles formed using known materials and method can be used. For example, fine particles described in Japanese Examined Patent Application Publication No. 62-1426 and Japanese Unexamined Patent Application Publication Nos. 3-56573, 3-79678, 3-160068, and 4-18462 may be used. Also, a commercial product can be used, and examples thereof include Microgel E-1002 and Microgel E-5002 (trade name, manufactured by Nippon Paint Co., Ltd.), Boncoat 4001 and Boncoat 5454 (trade names, manufactured by Dainippon Ink & Chemicals, Inc.), SAE1014 (trade name, manufactured by Nippon Zeon Co., Ltd.), Saibinol SK-200 (trade name, manufactured by Saiden Chemical Industry Co., Ltd.), Joncryl 7100, Joncryl 390, Joncryl 711, Joncryl 511, Joncryl 7001, Joncryl 632, Joncryl 741, Joncryl 450, Joncryl 840, Joncryl 74J, Joncryl HRC-1645J, Joncryl 734, Joncryl 852, Joncryl 7600, Joncryl 775, Joncryl 537J, Joncryl 1535, Joncryl PDX-7630A, Joncryl 352J, Joncryl 352D, Joncryl PDX-7145, Joncryl 538J, Joncryl 7640, Joncryl 7641, Joncryl 631, Joncryl 790, Joncryl 780, and Joncryl 7610 (trade name, manufactured by BASF Japan Inc.).

When the resin component is used in the form of fine particles, from the viewpoint of securing storage stability and ejection stability of the aqueous ink composition, the average particle diameter is preferably in a range of 5 nm to 400 nm and more preferably in a range of 50 nm to 200 nm.

The content of the resin component is preferably 0.1% by mass or more and 15% by mass or less and more preferably 0.5% by mass or more and 10% by mass or less in terms of solid content based on the total amount of the aqueous ink composition. Within this range, the aqueous ink composition used in the ink jet recording method according to the embodiment can be solidified and fixed even on plastic media.

(3) Water-Soluble Organic Solvent

The aqueous ink composition used in the ink jet recording apparatus according to the embodiment contains a water-soluble organic solvent having a boiling point of 250° C. or less. With the water-soluble organic solvent having a boiling point of 250° C. or less, the drying property of the ink component ejected on a recording medium is improved, and an image with good abrasion resistance can be formed.

Examples of the water-soluble organic solvent having a boiling point of 250° C. or less and used in the aqueous ink composition include 1,2-alkanediols, polyhydric alcohols, pyrrolidone derivatives, and the like.

The 1,2-alkanediols are not particularly limited as long as they have a boiling point of 250° C. or less. Examples thereof include 1,2-butanediol (boiling point; 194° C.), 1,2-pentanediol (boiling point; 206° C.), 1,2-hexanediol (boiling point; 223° C.), and the like. Since the 1,2-alkanediols are excellent in the function of enhancing wettability of recording media with the ink composition and uniformly wetting the recording media, excellent images can be formed on the recording media. The content of 1,2-alkanediol is preferably 1% by mass or more and 8% by mass or less based on the total mass of the aqueous ink composition.

The polyhydric alcohols are not particularly limited as long as they have a boiling point of 250° C. or less. Examples thereof include ethylene glycol (boiling point; 197° C.), diethylene glycol (boiling point; 244° C.), propylene glycol (boiling point; 188° C.), dipropylene glycol (boiling point; 232° C.), 1,3-propanediol (boiling point; 210° C.), 1,4-butanediol (boiling point; 230° C.), 1,6-hexanediol (boiling point; 208° C.), and the like. Among these, ethylene glycol, diethylene glycol, propylene glycol, dipropylene glycol, and 1,6-hexanediol are preferred from the viewpoint that these polyhydric alcohols have high vapor pressure and do not inhibit the drying property of an image. The polyhydric alcohols having the function of preventing clogging and defective ejection by suppressing drying and solidification of an ink on a nozzle surface of an ink jet head and having high vapor pressure are preferred from the viewpoint that they are preferably evaporated and scattered together with water. The content of a polyhydric alcohol is preferably 2% by mass or more and 20% by mass or less based on the total mass of the aqueous ink composition.

The pyrrolidone derivatives are not particularly limited as long as the boiling point is 250° C. or less. Examples thereof include N-methyl-2-pyrrolidone, N-ethyl-2-pyrrolidone, N-vinyl-2-pyrrolidone, 2-pyrrolidone, N-butyl-2-pyrrolidone, 5-methyl-2-pyrrolidone, and the like. The pyrrolidone derivatives function as a good resolvent for thermoplastic resins. The content of the pyrrolidone derivative is preferably 3% by mass or more and 25% by mass or less based on the total mass of the aqueous ink composition.

(4) Surfactant

The water-soluble ink composition used in the ink jet recording apparatus according to the embodiment contains a surfactant. As the surfactant, a silicon-based surfactant and an acetylene glycol surfactant can be used.

As the silicon-based surfactant, a polysiloxane compound, for example, polyether-modified organosiloxane, can be preferably used. More specific examples thereof include BYK-306, BYK-307, BYK-333, BYK-341, BYK-345, BYK-346, and BYK-348 (trade name, manufactured by BYK Chemie Japan, Inc.), and KF-351A, KF-352A, KF-353, KF-354L, KF-355A, KF-615A, KF-945, KF-640, KF-642, KF-643, KF-6020, X-22-4515, KF-6011, F-6012, KF-6015, and KF-6017 (trade names, all manufactured by Shin-Etsu Chemical Co., Ltd.). The silicon-based surfactants are preferred from the viewpoint that they have the function of uniformly spreading an ink on plastic media without density unevenness and blurring. The content of the silicon-based surfactant is preferably 0.1% by mass or more and 1.5% by mass or less based on the total mass of the aqueous ink composition.

Examples of the acetylene glycol-based surfactant include Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, and GA (trade name, manufactured by Air Products and Chemicals. Inc.); Olfine B, Y, P, A, STG, SPC, E1004, E1010, PD-001, PD-002W, PD-003, PD-004, EXP. 4001, EXP. 4036, EXP. 4051, AF-103, AF-104, AK-02, SK-14, and AE-3 (trade name, manufactured by Nissin Chemical Industry Co., Ltd.); and Acetylenol E00, E00P, E40, and E100 (trade name, manufactured by Kawaken Fine Chemicals Co., Ltd.). In comparison with other surfactants, the acetylene glycol-based surfactants are excellent in the ability to properly maintain surface tension and interfacial tension and have the property of having substantially no foaming property. Therefore, the aqueous ink composition containing the acetylene glycol-based surfactant can properly maintain surface tension and interfacial tension with a member in contact with an ink, such as a head nozzle surface, thereby enhancing ejection stability when being applied to an ink jet recording system. In addition, since the aqueous ink composition containing the acetylene glycol-based surfactant exhibits good wettability and permeability to recording media, high-definition images with little ink density unevenness and blurring can be formed. The content of the acetylene glycol-based surfactant is preferably 0.1% by mass or more and 1.0% by mass or less based on the total mass of the aqueous ink composition.

(5) Water

The aqueous ink composition used in the ink jet recording apparatus according to the embodiment contains water. The water is a main medium in the aqueous ink composition and is a component to be evaporated and scattered by heating. The water is preferably pure water or ultrapure water, such as ion exchanged water, ultrafiltered water, Milli-Q water, distilled water, or the like, from which ionic impurities are removed as much as possible. In addition, use of water sterilized by ultraviolet irradiation or addition of hydrogen peroxide is preferred because the occurrence of fungi or bacteria can be prevented when the pigment dispersion solution and the aqueous ink composition using the pigment dispersion solution are stored over a long time.

(6) Other Components

The aqueous ink composition used in the ink jet recording apparatus according to the embodiment can further contain a pH adjuster, polyolefin wax, a preservative/fungicide, an anticorrosive agent, a chelating agent, etc. Adding these materials is preferred from the viewpoint of further improving the characteristics of the aqueous ink composition.

Examples of the pH adjuster include potassium dihydrogen phosphate, disodium hydrogen phosphate, sodium hydroxide, lithium hydroxide, potassium hydroxide, ammonia, diethanolamine, triethanolamine, triisopropanolamine, potassium carbonate, sodium carbonate, sodium hydrogen carbonate, and the like.

Examples of the polyolefin wax include wax which is produced from olefins such as ethylene, propylene, butylene, or the like or a derivative thereof, and copolymers thereof. Specific examples thereof include polyethylene wax, polypropylene wax, polybutylene wax, and the like. As the polyolefin wax, a commercial product can be used, and specifically, Nopcoat PEM17 (trade name, manufactured by San Nopco Ltd.), Chemipearl W4005 (trade name, manufactured by Mitsui Chemicals, Inc.), and AQUACER 515 and AQUACER 593 (trade name, manufactured by BYK Chemie Japan, Inc.) can be used.

Adding the polyolefin wax is preferred from the viewpoint of improving slippage in physical contact of images formed on plastic media and also improving abrasion resistance of images. The content of the polyolefin wax is preferably 0.01% by mass or more and 10% by mass or less and more preferably 0.05% by mass or more and 1% by mass or less based on the total mass of the aqueous ink composition. With the polyolefin wax at a content within this range, the above-described effect is sufficiently exhibited.

Examples of the preservative/fungicide include sodium benzoate, sodium pentachlorophenol, sodium 2-pyridinethiol-1-oxide, sodium sorbate, sodium dehydroacetate, 1,2-dibenzisothiazolin-3-one, and the like. Examples of commercial products include Proxel XL2 and Proxel GXL (trade name, manufactured by Avecia Ltd.), and Denicide CSA and NS-500W (trade name, manufactured by Nagase Chemtex Corporation).

Examples of the anticorrosive agent include benzotriazole and the like.

Examples of the chelating agent include ethylenediamine tetraacetic acid and salts thereof (disodium dihydrogen ethylenediamine tetraacetate and the like), and the like.

(7) Usage

Since the aqueous ink composition has the very good ink drying property, it can be preferably used for printing on non-ink-absorbing or low-ink-absorbing recording media.

Examples of the non-ink-absorbing recording media include recording media each including a substrate, such as a plastic film or paper, which is coated with plastic, and recording media each including a substrate and a plastic film bonded thereon, the substrate being not surface-treated for ink jet printing (i.e., an ink-absorbing layer is not formed thereon). As the plastic film, a film of polyvinyl chloride, polyethylene terephthalate, polycarbonate, polystyrene, polyurethane, polyethylene, polypropylene, or the like can be used. Examples of the low-ink-absorbing recording media include printing paper such as art paper, coated paper, matte paper, and the like. In the specification, the non-ink-absorbing or low-ink-absorbing recording media are also simply referred to as "plastic media".

In the specification, "non-ink-absorbing or low-ink-absorbing recording media" represents recording media exhibiting an amount of water absorption of 10 $mL/m^2$ or less within 30 $msec^{1/2}$ from a start of contact in the Bristow method. The Bristow method is a method most popularized as a method for measuring an amount of liquid absorbed within a short time and is used in Japan Technical Association of the Pulp and Paper Industry (JAPAN TAPPI). The details of the test method are described in "Liquid Absorbency Test Method of Paper and Paperboard-Bristow Method" of standard No. 51 of "JAPAN TAPPI paper pulp test method, 2000".

2. Second Embodiment

An ink jet recording apparatus according to a second embodiment is different from the ink jet recording apparatus according to the first embodiment in at least the following points. That is, the ink jet recording apparatus according to the second embodiment is different from at least the ink jet recording apparatus 100 according to the first embodiment in that a plurality of ejection heads are provided and in that a second cap device is provided to correspond to each of the ejection heads. In the ink jet recording apparatus according to the second embodiment, the same members as those used in the first embodiment can be used, and the same members are not described in detail below. The ink jet recording apparatus according to the second embodiment can have the same operations and advantages as the first embodiment, and the same operations and advantages are not described.

Figure 6:
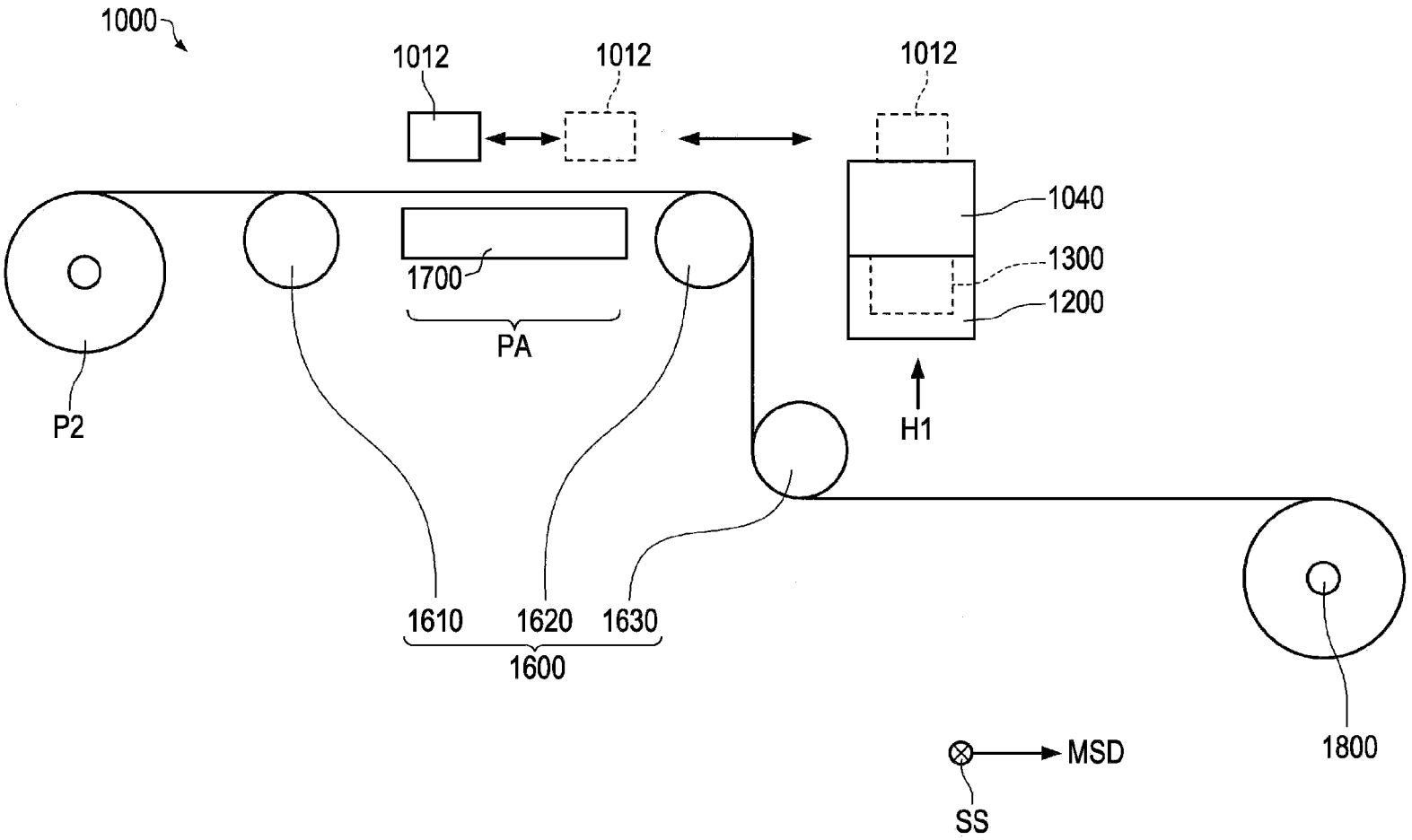
FIG. 6 is an explanatory view showing a schematic configuration of an ink jet recording apparatus according to a second embodiment.

FIG. 6 is a side view schematically showing an ink jet recording apparatus 1000 according to the second embodiment. The ink jet recording apparatus 1000 according to the second embodiment is described in detail below with reference to FIG. 6. The same members as in the first embodiment are not described.

In FIG. 6, the jet recording apparatus 1000 includes a transfer portion 1600, a carriage 1012, a suction table 1700, a first cap device 1040, a second cap device 1300, a third cap device 1200, and a take-up mechanism 1800.

The transfer portion 16000 is adapted for transferring a rolled printing medium P2 in a main scanning direction MSD (also referred to as a "transfer direction" hereinafter). The transfer portion 1600 includes transfer rollers 1610, 1620, and 1630. The transfer roller 1610 moves the rolled printing medium P2 before printing to the suction table 1700. The transfer rollers 1620 and 1630 move, after printing, the rolled printing medium P2 in the transfer direction.

The suction table 1700 is provided in the printing area PA in order to hold the rolled printing medium P2 by suction from a non-printing surface. Suction of the rolled printing medium P2 by the suction table 1700 is not particularly limited and can be performed using a known suction device.

An ink cartridge (not shown) is mounted on the carriage 1012. Also, an ejection head is mounted on the lower side of the carriage 1012. The carriage 1012 moves the ejection head (not shown) to a desired position using a driving mechanism (not shown), and the printing medium P2 is reciprocated in the main scanning direction MSD and a sub-scanning direction SS so that printing is performed by ejecting an ink from the ejection head (not shown) within the printing area PA.

The take-up mechanism 1800 is a mechanism which takes up the printing medium P2 transferred in the transfer direction after printing. For example, a take-up roller can be used.

Figure 7:
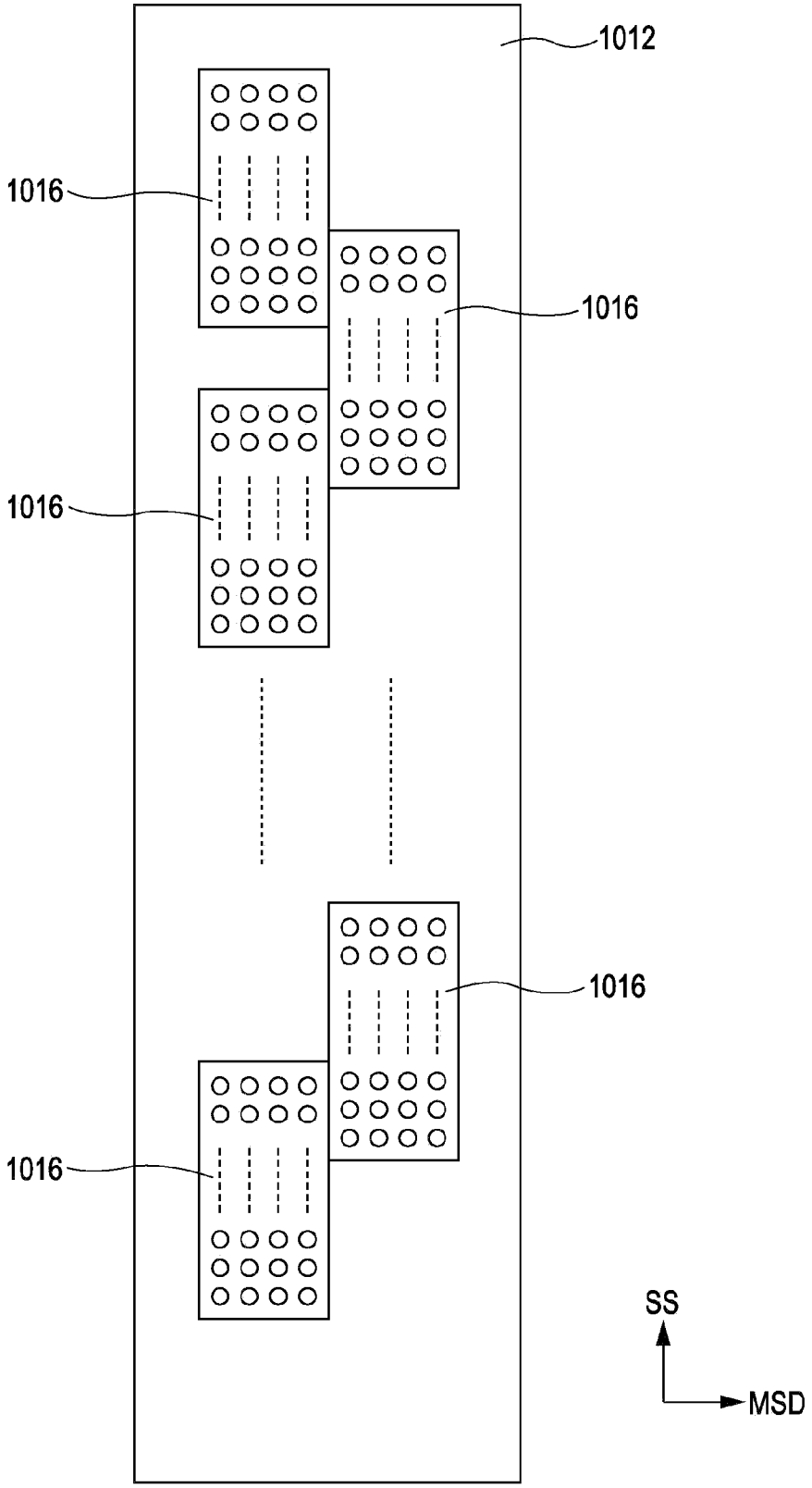
FIG. 7 is an explanatory view showing a lower surface of a carriage of the ink jet recording apparatus according to the second embodiment.

FIG. 7 shows a lower surface (surface facing the printing medium P2) of the carriage 1012, where a plurality of ejection heads 1016 are provided along the sub-scanning direction SS. The ejection heads 1016 may be provided with a width larger than the width of the printing medium P2 in the sub-scanning direction SS so that the ink can be ejected over the whole width of the printing medium P2 in the sub-scanning direction SS. In addition, in the example shown in FIG. 7, each of the ejection heads 1016 is provided with four lines of nozzles which eject ink in the main scanning direction, but is not limited to this and may be provided with four or more lines of nozzles.

In addition, printing may be performed on the printing medium P2 by moving the carriage 1012 only in the main scanning direction MSD, not in the sub-scanning direction SS. Printing may be performed on the printing medium P2 while transferring the printing medium P2 in the transfer direction with the ejection heads fixed at a position facing the printing medium P2. In addition, the carriage 1012 may be disposed so that the main scanning direction MSD of the carriage 1012 shown in FIG. 7 coincides with the sub-scanning direction shown in FIG. 6.

The ink jet recording apparatus according to this embodiment includes the first cap device, the second cap device, and the third cap device. Since the configurations and functions of these cap devices are the same as those of the cap devices of the first embodiment except some portions, the same configurations and functions are not described. With respect to the cap devices of the second embodiment, a configuration and function different from the cap devices of the first embodiment are described below.

Figure 8:
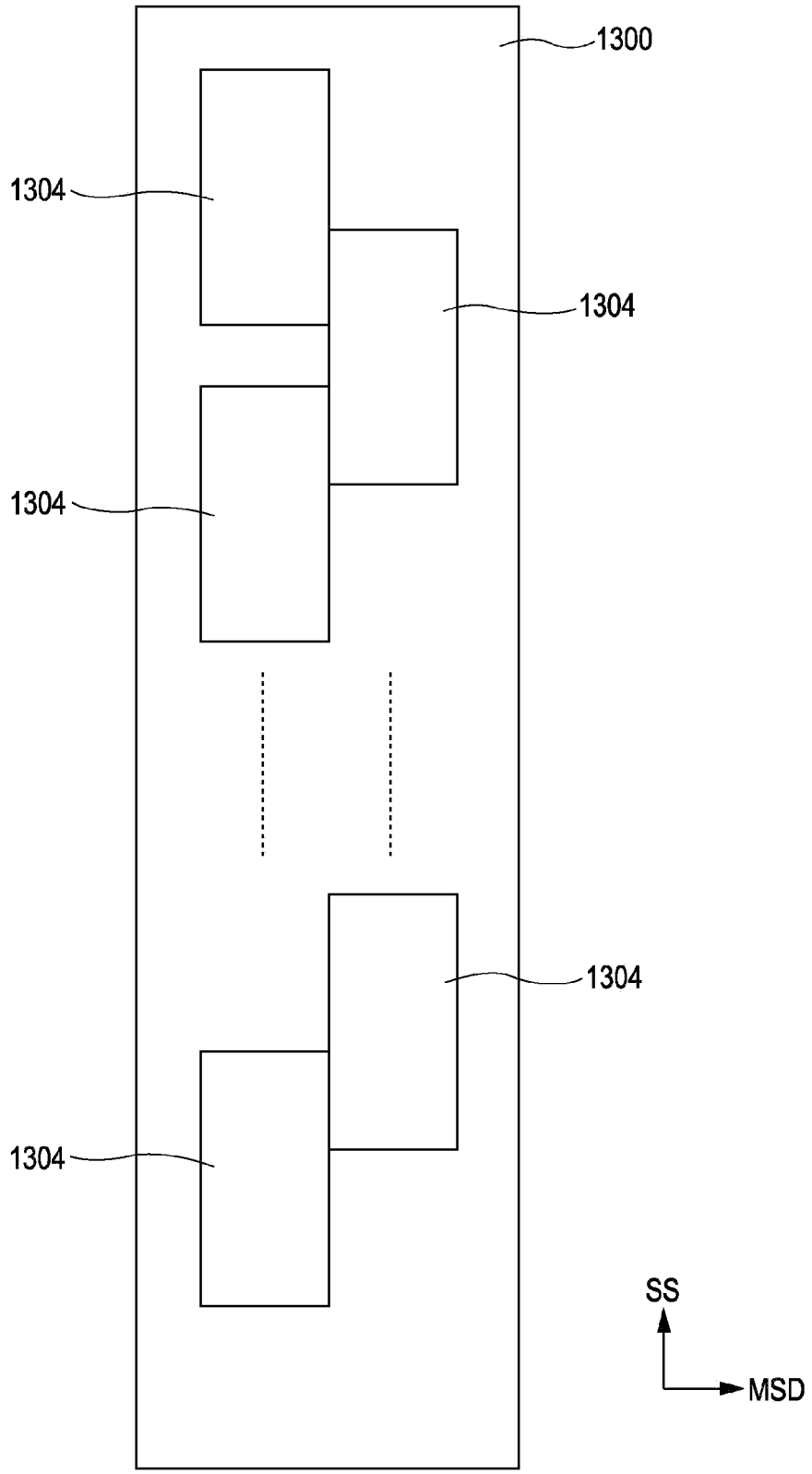
FIG. 8 is an explanatory view showing a second cap device of the ink jet recording apparatus according to the second embodiment.

In the example shown in FIG. 6, the second cap device 1300 is disposed at the home position H1. FIG. 8 is a schematic plan view showing the inside of the second cap device 1300. In an example shown in FIG. 8, the second cap device 1300 is provided to correspond to the ejection heads 1016 and includes a plurality of cap portions 1304. The second cap device 1300 is connected to a suction device (not shown) which sucks the aqueous ink composition. Therefore, in the ink jet recording apparatus 1000 according to the second embodiment, an ink can be sucked by the cap portions 1304 for the respective ejection heads 1016 in a suction recovery operation. Thus, the volume in a cap can be decreased to achieve good suction efficiency as compared with the case of a cap which collectively covers the plurality of ejection heads 1016 and sucks an ink.

A suction device may be provided so that the aqueous ink composition can be sucked collectively from the plurality of cap portions 1304 or a suction device may be connected to each of the cap portions 1304. When the suction device is connected to each of the cap portions 1304, suction may be performed in only part of the plurality of ejection heads 1016, where ejection failure occurs, and thus useless suction is avoided.

In the example shown in FIG. 6, the first cap device 1040 is disposed at the home position H1 and is connected to a first maintenance liquid supply device (not shown). The first cap device 1040 preferably has a structure in which all the ejection heads 1016 are collectively covered. In this case, the plurality of ejection heads 1016 can be collectively moisturized. In addition, since a maintenance liquid supply device need not be provided for each of the plurality heads, an attempt can be made to miniaturize and simplify the ink jet recording apparatus 1000. Further, the amount of the maintenance liquid can be collectively controlled, thereby facilitating the control. When the optical sensor described in the first embodiment is applied to the second embodiment, a plurality of optical sensors need not be provided, and thus the configuration of the ink jet recording apparatus according to this embodiment can be simplified.

In the example shown in FIG. 6, the third cap device 1200 is provided at the home position H1. The third cap device 1200 is connected to a second maintenance liquid supply device (not shown). The functions and advantages of the third cap device 1200 according to the second embodiment are the same as in the first embodiment and are thus not described.

3. Examples

Although the present invention is described below with reference to examples, the present invention is not limited to these examples.

3.1. Preparation of Pigment Dispersion Solution

First, 20 parts by mass of MA8 (trade name, manufactured by Mitsubishi Chemical Co., Ltd.) used as a carbon black pigment, 76 parts by mass of ion exchange water in which 1.5 parts by mass of a 30% aqueous ammonia solution (neutralizing agent) was dissolved, and 7.5 parts by mass of an acrylic acid-acrylate copolymer (weight-average molecular weight: 25,000, acid value: 180) as a resin dispersant were well mixed and agitated, followed by dispersion with a ball mill using zirconia beads for 10 hours to prepare a dispersion raw material. The dispersion raw material was filtered with a stainless mesh filter with a pore size of 10 μm to remove impurities, and adjusted so that the pigment concentration was 20% by mass, thereby preparing a black pigment dispersion solution $b_1$.

Further, a yellow pigment dispersion solution $y_1$, a magenta pigment dispersion solution $m_1$, a cyan pigment dispersion solution $c_1$, an orange pigment dispersion solution $o_1$, and a green pigment dispersion solution $g_1$ were prepared by the same method as for preparing the black pigment dispersion solution except that C. I. Pigment Yellow 180, C. I. Pigment Red 122, C. I. Pigment Blue 15:3, C. I. Pigment Orange 43, and C. I. Pigment Green 36, respectively, were used in place of the carbon black pigment.

3.2. Preparation of Ink Composition

Each of the thus-prepared pigment dispersion solutions and components were mixed at the mixing ratios shown in Table 1, and the resultant mixture was stirred for 2 hours and then filtered with a membrane filter having a pore size of 10 μm. As a result, ink compositions B1, Y1, C1, O1, and G1 were prepared. In Table 1, the unit of each numerical value is % by mass.

TABLE 1

| Aqueous ink composition | B1 | Y1 | M1 | C1 | O1 | G1 |
|---|---|---|---|---|---|---|
| | Type | | | | | |
| Pigment dispersion | b1 | y1 | m1 | c1 | o1 | g1 |
| | Content | | | | | |
| solution | 20 | 20 | 20 | 20 | 20 | 20 |
| 1,2-Hexanediol | 5 | 5 | 5 | 5 | 5 | 5 |
| Propylene glycol | 10 | 10 | 10 | 10 | 11 | 11 |
| BYK-348 (silicone-based surfactant) | 0.9 | 0.9 | 0.9 | 0.9 | 0.9 | 0.9 |
| Surfynol (acetylene glycol-based surfactant) | 0.1 | 0.1 | 0.1 | 0.1 | 0.1 | 0.1 |
| Styrene-acrylic acid copolymer emulsion dispersion solution <Tg: 50° C., 50% dispersion solution> | 2 | 2 | 2 | 2 | 2 | 2 |
| AG-515 (polyethylene wax) | 0.5 | 0.5 | 0.5 | 0.5 | 0.5 | 0.5 |
| Triisopropanolamine (pH adjuster) | 0.1 | 0.1 | 0.1 | 0.1 | 0.1 | 0.1 |
| Ethylenediamine tetraacetic acid (chelating agent) | 0.05 | 0.05 | 0.05 | 0.05 | 0.05 | 0.05 |
| Benzotriazole (antiseptic agent) | 0.02 | 0.02 | 0.02 | 0.02 | 0.02 | 0.02 |
| Ion exchange water | Balance | Balance | Balance | Balance | Balance | Balance |
| Total | 100 | 100 | 100 | 100 | 100 | 100 |

3.3. Preparation of Maintenance Liquid (1) Maintenance Liquid A1

A maintenance liquid A1 was prepared by well mixing and stirring 5% by mass of propylene glycol monomethyl ether (boiling point; 121° C.), 0.1% by mass of C. I. Acid Blue 9, 0.05% by mass of triethanolamine, and 94.85% by mass of pure water.

(2) Maintenance Liquid A2

A maintenance liquid A2 of an example was prepared by well mixing and stirring 1% by mass of 1,2-hexanediol (boiling point; 223° C.), 0.0005% by mass of C. I. Direct Red 189, 0.01% by mass of triethanolamine, and 98.9895% by mass of pure water.

(3) Maintenance Liquid A3

Pure water was used as a maintenance liquid A3.

(4) Maintenance Liquid A4

A maintenance liquid A4 was prepared by well agitating and mixing 5% by mass of glycerin (boiling point; 290° C.) and 95% by mass of pure water.

3.4. Ink Jet Recording Apparatus

As an ink jet recording apparatus used in an evaluation test, an ink jet printer (manufactured by Seiko Epson Corporation, product name "PX-G930") was modified so as to have the same configuration as the ink jet recording apparatus shown in FIG. 1. Specifically, an ink jet printer X was produced by modifying the ink jet printer (manufactured by Seiko Epson Corporation, product name "PX-G930") so as to include a first cap device, a second cap device, a third cap device, a first maintenance liquid supply device, and a second maintenance liquid supply device.

In the ink jet printer X, an ink cartridge was filled with each of the ink compositions B1, Y1, M1, C1, O1, and G1 prepared in the above "3.2. Preparation of ink composition. Then, any one of the maintenance liquids A1 to A4 prepared in "3.3. Preparation of maintenance liquid" was supplied to the first maintenance liquid supply device and the second maintenance liquid supply device.

3.5. Evaluation Test 3.5.1. Evaluation of Drying by Allowing to Stand

In the evaluation test, the ink jet printer X was allowed to stand for a long time, and the drying states of the first cap device and the second cap device were examined. The evaluation was performed according to the procedures below.

First, the ink jet printer X in a standby state (state shown in FIG. 2) was operated to perform suction recovery (operations from FIG. 4 to FIG. 5). Then, after cleaning of the ejection head was carried out by suction recovery, a nozzle check pattern was printed on a recording medium (product name "Cold Lamination Film PG-50L" manufactured by Lami Corporation) to confirm that an ink was ejected from all nozzles. After it was confirmed that an ink was ejected from all nozzles, the ink jet printer X was returned to the standby state (state shown in FIG. 2) and then allowed to stand at a room temperature of 40° C. for 30 days after the power was turned off.

After allowing to stand for 30 days, the power of the ink jet printer X was turned on, and a nozzle check pattern for the ejection head was printed on a recording medium (product name "Cold Lamination Film PG-50L" manufactured by Lami Corporation) (hereinafter, referred to as "a. Nozzle check evaluation immediately after power on").

Then, an operation of suction recovery was carried out (hereinafter, referred to as "b. Suction recovery evaluation").

Next, a nozzle check pattern was again printed (hereinafter, referred to as "c. Nozzle check evaluation after suction recovery operation"). Then, the ink jet printer X was returned to the standby state, and the power was turned off.

Also, the same evaluation of drying by allowing to stand as described above was performed except that the ink jet printer X was allowed to stand for each of 60 days and 90 days.

The criteria for evaluation are as follows:

<a. Nozzle check evaluation immediately after power on>

A: Ejection of ink from all nozzles

B: No ejection of ink from some nozzles

<b. Suction recovery evaluation>

A: Possible to perform suction recovery

B: Impossible to perform suction recovery because of thickening of residual ink in cap.

<c. Nozzle check evaluation after suction recovery operation>

A: Ejection of ink from all nozzles

B: No ejection of ink from some nozzles 3.5.2. Evaluation of Storage Stability

In a container, 100 g of each of the maintenance liquids A1 to A4 was placed and allowed to stand at 30° C. for 2 weeks. After allowing to stand, each of the maintenance liquids was filtered with a membrane filter having a pore size of 5 μm, and the occurrence of fungi and microorganisms remaining on the filter was confirmed with a digital microscope (product name "VHX-200" manufactured by Keyence Corporation). Evaluation criteria are as follows:

A: Possible to filter a total of 100 g without confirmation of fungi or microorganisms on the filter B: Possible to filter a total of 100 g with confirmation of fungi or microorganisms on the filter C: Impossible to filter a total of 100 g with confirmation of fungi or microorganisms on the filter 3.6. Evaluation Results The results of the above evaluation tests are shown in Table 2.

TABLE 2

| | | | Example 1 | Example 2 | Comparative Example 1 | Comparative Example 2 |
|---|---|---|---|---|---|---|
| Long-term leaving test | 30 days | a. Nozzle check evaluation immediately after power on | A | A | B | A |
| | | b. Suction recovery evaluation | A | A | A | A |
| | | a. Nozzle check evaluation after suction recovery operation | A | A | A | A |
| | 60 days | a. Nozzle check evaluation immediately after power on | A | A | B | A |
| | | b. Suction recovery evaluation | A | A | B | B |
| | | c. Nozzle check evaluation after suction recovery operation | A | A | B | B |
| | 90 days | a. Nozzle check evaluation immediately after power on | B | A | B | B |
| | | b. Suction recovery evaluation | A | A | B | B |
| | | c. Nozzle check evaluation after suction recovery operation | A | A | B | B |
| Evaluation of storage stability | | | A | A | B | C |

Table 2 confirms that when the first cap device and the second cap device are moisturized with the maintenance liquids A1 and A2 of Example 1 and Example 2, respectively, even after the ink jet recording apparatus is allowed to stand for a long time, nozzle clogging does not occur, and if nozzle clogging occurs, the nozzle clogging can be removed by suction recovery. Also, it is confirmed that the maintenance liquids A1 and A2 of Example 1 and Example 2 have good antiseptic properties.

Table 2 confirms that even when the first cap device and the second cap device are moisturized with the maintenance liquids A3 and A4 of Comparative Example 1 and Comparative Example 2, respectively, the characteristics of the apparatus cannot be maintained after the ink jet recording apparatus is allowed to stand for a long time. In detail, when the maintenance liquid A3 of Comparative Example 1 was used, the first cap device was dried by allowing to stand for 30 days, and nozzle clogging was observed in the nozzle check evaluation immediately after turning on the power, but the nozzle clogging was removed in nozzle check evaluation after suction recovery. However, after allowing to stand for 60 days, the maintenance liquid was not supplied to the first cap device because the first maintenance liquid tank was emptied, thereby causing nozzle clogging. Similarly, after allowing to stand for 60 days, the maintenance liquid was not supplied to the third cap device because the second maintenance liquid tank was emptied. Consequently, the third cap device was dried, and suction recovery was made impossible due to thickening and solidification of residual ink in the second cap device. Therefore, the characteristics of both the first cap device and the second dap device could not be exhibited.

With the maintenance liquid A4 of Comparative Example 2, neither the first cap device nor the second cap device was dried after allowing to stand for 30 days. However, after allowing to stand for 60 days, glycerin contained in the maintenance liquid A4 in the third cap device was concentrated and water was absorbed from the residual ink in the second cap device, and thus the residual ink was thickened and solidified, thereby making suction recovery impossible. Further, in this state, when a suction recovery operation was performed, part of the thickened and solidified ink in the second cap device adhered to the nozzle surface, causing nozzle clogging. Similarly, after allowing to stand for 90 days, the characteristics of the apparatus were not recovered, and the maintenance liquid A4 containing the concentrated glycerin remained in the first cap device and the third cap device.

Also, it is confirmed that the maintenance liquids of Comparative Example 1 and Comparative Example 2 have bad antiseptic properties.

As described above, the evaluation results of the examples and the comparative examples indicate that when the maintenance liquid of Example 1 or 2 is supplied to at least the first cap device, the nozzle check evaluation after a suction recovery operation shows good results, and the storage stability evaluation of the maintenance liquid show good results.

The present invention is not limited to the above-described embodiments, and various modifications can be made. For example, the present invention includes substantially the same configuration (for example, a configuration with the same function, method, and results, or a configuration with the same objects and advantages) as in the above-described embodiments. Also, the present invention includes a configuration in which a nonessential portion of the configurations described in the embodiments is replaced. Further, the present invention includes a configuration exhibiting the same operations and advantages or being capable of achieving the same objects as in the configurations described in the embodiments. Further, the present invention includes a configuration in which a known technique is added to the configurations described in the embodiments.

What is claimed is:

1. An ink jet recording system, comprising:

an aqueous ink composition comprising a resin component, a water-soluble organic solvent having a boiling point of 250° C. or less and including at least one pyrrolidone derivative, a surfactant, and water, the aqueous ink composition not including a water-soluble organic solvent having a boiling point above 250° C.;

a maintenance liquid comprising water, and a water-soluble organic solvent of at least one of alkanediols having a boiling point of 250° C. or less and alkylene glycol monoether derivatives having a boiling point of 250° C. or less, the maintenance liquid not including a water-soluble organic solvent having a boiling point above 250° C.; and an ink jet recording apparatus comprising:

an ejection head configured to eject the aqueous ink composition, a first cap device configured to cover and moisturize the ejection head and form a substantially closed space at the ejection head, and a first maintenance supply device configured to supply the maintenance liquid to the first cap device, the supplied maintenance liquid being evaporated to humidify the substantially closed space.

2. The ink jet recording system according to claim 1, wherein the ink jet recording apparatus further comprises:

a second cap device configured to cover the ejection head and receive the aqueous ink composition discharged from the ejection head;

a suction device connected to the second cap device to draw the aqueous ink composition;

a third cap device configured to cover and moisturize the second cap device; and a second maintenance liquid supply device configured to supply the maintenance liquid to the third cap device.

3. The ink jet recording system according to claim 2, wherein the ink jet recording apparatus further comprises:

a heating device configured to heat the maintenance liquid supplied to at least one of the first cap device and the third cap device.

4. The ink jet recording system according to claim 2, further comprising:

an optical sensor disposed on or in at least one of the first cap device and the third cap device to detect an amount of the maintenance liquid.

5. The ink jet recording system according to claim 1, wherein the maintenance liquid further contains a pH adjuster.

6. The ink jet recording system according to claim 5, wherein the maintenance liquid is adjusted to pH in a range of 5.0 or more and 9.0 or less with the pH adjuster, and a material of a member constituting the first cap device is aluminum or an aluminum alloy.

7. The ink jet recording system according to claim 1, wherein the maintenance liquid further contains a water-soluble colorant.

8. The ink jet recording system according to claim 1, wherein the water-soluble organic solvent of the maintenance liquid comprises alkanediols comprising at least one selected from 1,2-propanediol, 1,2-pentanediol, 1,2-hexanediol, 1,6-hexanediol, and 2,2-dimethylpropane-1,3-diol (neopentyl glycol).

9. The ink jet recording system according to claim 1, wherein the water-soluble organic solvent of the maintenance liquid comprises alkylene glycol monoether derivatives comprising at least one selected from ethylene glycol monomethyl ether, diethylene glycol monomethyl ether, ethylene glycol monobutyl ether, diethylene glycol monobutyl ether, and propylene glycol monomethyl ether.

10. The ink jet recording system according to claim 1, wherein the content of the water-soluble organic solvent is from 0.05% to 5% by mass of the maintenance liquid.

11. The ink jet recording system according to claim 1, wherein the water content of the maintenance liquid is 95% by mass or more.

12. The ink jet recording system according to claim 1, wherein the water-soluble organic solvent having a boiling point of 250° C. or less included in the aqueous ink composition comprises at least one of 1,2-alkanediols which is 1% by mass or more and 8% by mass or less based on the total mass of the aqueous ink composition, at least one of polyhydric alcohols which is 2% by mass or more and 20% by mass or less based on the total mass of the aqueous ink composition.

13. The ink jet recording system according to claim 1, wherein the ink jet recording apparatus prints on a non-ink-absorbing or a low-ink-absorbing recording medium by ejecting the aqueous ink composition.

14. The ink jet recording system according to claim 1, wherein a content of the at least one pyrrolidone derivative is from 3% to 25% by mass based on a total mass of the aqueous ink composition.

* * * * *